US006145631A

United States Patent [19]

Hikita et al.

[11] Patent Number: 6,145,631

[45] Date of Patent: Nov. 14, 2000

[54] GROUP-CONTROLLER FOR ELEVATOR

[75] Inventors: Shiro Hikita, Tokyo; Shigeyuki Yokoe, Aichi, both of Japan

[73] Assignee: Mitsubishi Denki Kabushiki Kaisha, Tokyo, Japan

[21] Appl. No.: 09/180,375

[22] PCT Filed: Apr. 7, 1997

[86] PCT No.: PCT/JP97/01184

§ 371 Date: Nov. 9, 1998

§ 102(e) Date: Nov. 9, 1998

[87] PCT Pub. No.: WO98/45204

PCT Pub. Date: Oct. 15, 1998

[51] Int. Cl.[7] ..... B66B 1/20

[52] U.S. Cl. ..... 187/383; 187/387

[58] Field of Search ..... 187/380–389, 187/247

[56] References Cited

U.S. PATENT DOCUMENTS

| | | | |
|---|---|---|---|
| 4,064,971 | 12/1977 | Iwasaka et al. | 187/29 R |
| 4,982,817 | 1/1991 | Tsuji | 187/380 |
| 5,020,642 | 6/1991 | Tsuji | 187/380 |
| 5,058,711 | 10/1991 | Tsuji | 187/387 |
| 5,241,141 | 8/1993 | Cominelli | 187/116 |
| 5,250,766 | 10/1993 | Hikita et al. | 187/133 |
| 5,354,957 | 10/1994 | Robertson | 187/247 |

FOREIGN PATENT DOCUMENTS

| | | |
|---|---|---|
| 60-106774 | 6/1985 | Japan . |
| 63-97584 | 4/1988 | Japan . |
| 4-286581 | 10/1992 | Japan . |

*Primary Examiner*—Jonathan Salata
*Attorney, Agent, or Firm*—Leydig, Voit & Mayer

[57] ABSTRACT

A group-supervising control system for an elevator includes a cage position prediction unit for predicting cage positions after a predetermined time period based on the present positions, a service available time period distribution calculation unit for calculating the time periods until the service is available (predicted arrival times of a cage capable of responding to a hall call earliest) based on the predicted cage positions, and an assignment correction value calculation unit for calculating assignment correction values for correcting assignment estimation values based on the distributions of the time periods until the service is available. Unevenness in the time periods until the service is available with regard to the respective floors is decreased.

9 Claims, 31 Drawing Sheets

FIG. 8

| | UP | DN |
|---|---|---|
| 10TH FLOOR | | 32 |
| 9 | 20 | 34 |
| 8 | 18 | 36 |
| 7 | 16 | 38 |
| 6 | 14 | 40 |
| 5 | 12 | 42 |
| 4 | 0 | 44 |
| 3 | 54 | 46 |
| 2 | 52 | 48 |
| 1 | 50 | |

A

FIG. 9

| | UP | DN |
|---|---|---|
| 10TH FLOOR | | 40 |
| 9 | 38 | 42 |
| 8 | 26 | 44 |
| 7 | 14 | 46 |
| 6 | 12 | 48 |
| 5 | 0 | 50 |
| 4 | 64 | 52 |
| 3 | 62 | 54 |
| 2 | 60 | 56 |
| 1 | 58 | |

B

FIG. 10

| | UP | DN |
|---|---|---|
| 10TH FLOOR | | 2 |
| 9 | 0 | 0 |
| 8 | 2 | 2 |
| 7 | 4 | 4 |
| 6 | 6 | 6 |
| 5 | 8 | 8 |
| 4 | 10 | 10 |
| 3 | 12 | 12 |
| 2 | 14 | 14 |
| 1 | 16 | |

C

FIG. 11

| | UP | DN |
|---|---|---|
| 10TH FLOOR | | 2 |
| 9 | 0 | 0 |
| 8 | 2 | 2 |
| 7 | 4 | 4 |
| 6 | 6 | 6 |
| 5 | 0 | 8 |
| 4 | 0 | 10 |
| 3 | 12 | 12 |
| 2 | 14 | 14 |
| 1 | 16 | |

FIG. 12

| | UP | DN |
|---|---|---|
| 10TH FLOOR | | 2 |
| 9 | 0 | 0 |
| 8 | 2 | 2 |
| 7 | 4 | 4 |
| 6 | 6 | 6 |
| 5 | 8 | 8 |
| 4 | 0 | 6 |
| 3 | 4 | 4 |
| 2 | 2 | 2 |
| 1 | 0 | |

FIG. 13

| | UP | DN |
|---|---|---|
| 10TH FLOOR | | 18 |
| 9 | 16 | 0 |
| 8 | 14 | 2 |
| 7 | 4 | 4 |
| 6 | 2 | 6 |
| 5 | 0 | 8 |
| 4 | 6 | 6 |
| 3 | 4 | 4 |
| 2 | 2 | 2 |
| 1 | 0 | |

FIG. 18

| | UP | DN |
|---|---|---|
| 10TH FLOOR | | 18 |
| 9 | 16 | 16 |
| 8 | 14 | 14 |
| 7 | 12 | 12 |
| 6 | 10 | 10 |
| 5 | 8 | 8 |
| 4 | 6 | 6 |
| 3 | 4 | 4 |
| 2 | 2 | 2 |
| 1 | 0 | |

CAGE A

FIG. 20

| | UP | DN |
|---|---|---|
| 10TH FLOOR | | 2 |
| 9 | 0 | 0 |
| 8 | 2 | 2 |
| 7 | 4 | 4 |
| 6 | 6 | 6 |
| 5 | 8 | 8 |
| 4 | 10 | 10 |
| 3 | 12 | 12 |
| 2 | 14 | 14 |
| 1 | 16 | |

CAGE C

FIG. 19

| | UP | DN |
|---|---|---|
| 10TH FLOOR | | 2 |
| 9 | 36 | 4 |
| 8 | 34 | 6 |
| 7 | 32 | 8 |
| 6 | 30 | 10 |
| 5 | 28 | 12 |
| 4 | 26 | 14 |
| 3 | 24 | 56 |
| 2 | 22 | 18 |
| 1 | 20 | |

CAGE B

FIG. 21

| | UP | DN |
|---|---|---|
| 10TH FLOOR | | 2 |
| 9 | 0 | 0 |
| 8 | 2 | 2 |
| 7 | 4 | 4 |
| 6 | 6 | 6 |
| 5 | 8 | 8 |
| 4 | 6 | 6 |
| 3 | 4 | 8 |
| 2 | 2 | 2 |
| 1 | 0 | |

FIG. 22
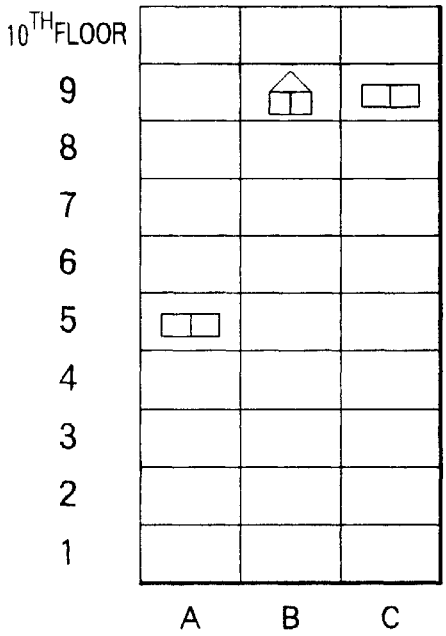
FIG. 24
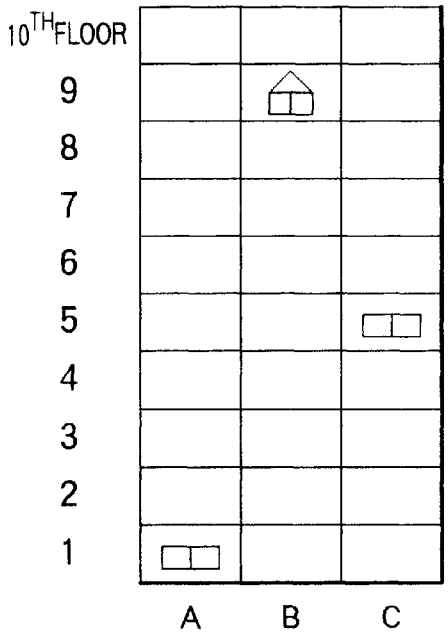
FIG. 23
| | UP | DN |
|---|---|---|
| 10TH FLOOR | | 2 |
| 9 | 0 | 0 |
| 8 | 2 | 2 |
| 7 | 4 | 4 |
| 6 | 2 | 2 |
| 5 | 0 | 0 |
| 4 | 2 | 2 |
| 3 | 4 | 4 |
| 2 | 6 | 6 |
| 1 | 8 | |
FIG. 25
| | UP | DN |
|---|---|---|
| 10TH FLOOR | | 2 |
| 9 | 0 | 4 |
| 8 | 6 | 6 |
| 7 | 4 | 4 |
| 6 | 2 | 2 |
| 5 | 0 | 0 |
| 4 | 2 | 2 |
| 3 | 4 | 4 |
| 2 | 2 | 2 |
| 1 | 0 | |

FIG. 28
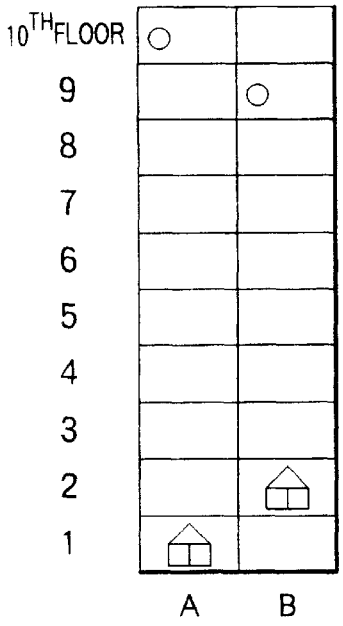
FIG. 29
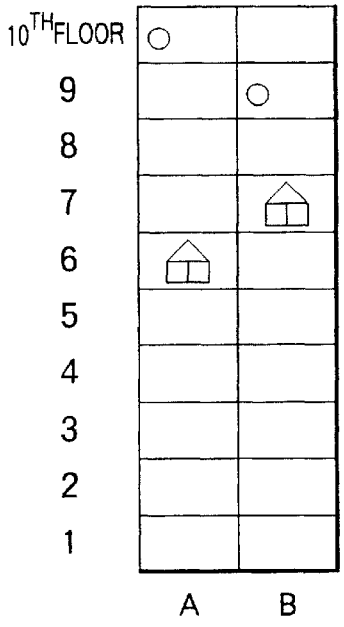
FIG. 30
| | UP | DN |
|---|---|---|
| 10TH FLOOR | | 8 |
| 9 | 6 | 20 |
| 8 | 4 | 22 |
| 7 | 2 | 24 |
| 6 | 0 | 26 |
| 5 | 44 | 28 |
| 4 | 42 | 30 |
| 3 | 40 | 32 |
| 2 | 38 | 34 |
| 1 | 36 | |
CAGE A
FIG. 31
| | UP | DN |
|---|---|---|
| 10TH FLOOR | | 16 |
| 9 | 4 | 18 |
| 8 | 2 | 20 |
| 7 | 0 | 22 |
| 6 | 44 | 24 |
| 5 | 42 | 26 |
| 4 | 40 | 28 |
| 3 | 38 | 30 |
| 2 | 36 | 32 |
| 1 | 34 | |
CAGE B
FIG. 32
| | UP | DN |
|---|---|---|
| 10TH FLOOR | | 8 |
| 9 | 4 | 18 |
| 8 | 2 | 20 |
| 7 | 0 | 22 |
| 6 | 0 | 24 |
| 5 | 42 | 26 |
| 4 | 40 | 28 |
| 3 | 38 | 30 |
| 2 | 36 | 32 |
| 1 | 34 | |

FIG. 33
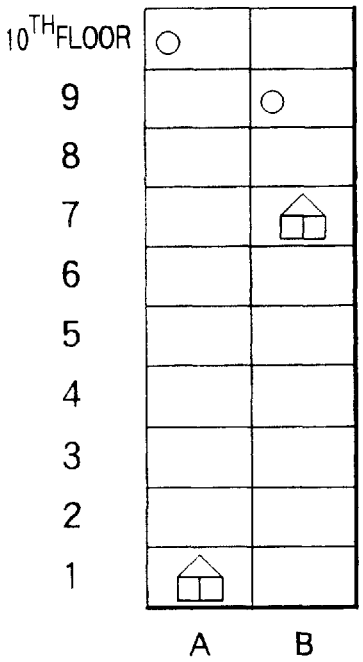
FIG. 35
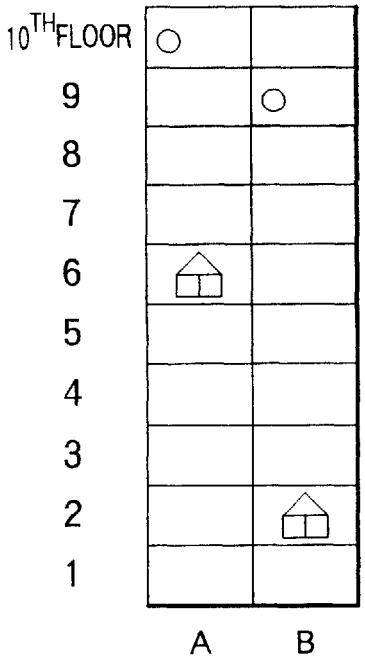
FIG. 34
| | UP | DN |
|---|---|---|
| 10TH FLOOR | | 16 |
| 9 | 4 | 18 |
| 8 | 2 | 20 |
| 7 | 0 | 22 |
| 6 | 10 | 24 |
| 5 | 8 | 26 |
| 4 | 6 | 28 |
| 3 | 4 | 30 |
| 2 | 2 | 32 |
| 1 | 0 | |
FIG. 36
| | UP | DN |
|---|---|---|
| 10TH FLOOR | | 18 |
| 9 | 6 | 20 |
| 8 | 4 | 22 |
| 7 | 2 | 24 |
| 6 | 0 | 26 |
| 5 | 6 | 28 |
| 4 | 4 | 30 |
| 3 | 2 | 32 |
| 2 | 0 | 34 |
| 1 | 36 | |

FIG. 39

| | UP | DN |
|---|---|---|
| 10TH FLOOR | | 200 |
| 9 | 0 | 60 |
| 8 | 10 | 40 |
| 7 | 20 | 10 |
| 6 | 40 | 20 |
| 5 | 30 | 10 |
| 4 | 70 | 50 |
| 3 | 20 | 10 |
| 2 | 10 | 20 |
| 1 | 300 | |

FIG. 40

| | UP | DN |
|---|---|---|
| 10TH FLOOR | | 400 |
| 9 | 0 | 0 |
| 8 | 20 | 80 |
| 7 | 80 | 40 |
| 6 | 240 | 120 |
| 5 | 0 | 80 |
| 4 | 0 | 500 |
| 3 | 240 | 120 |
| 2 | 140 | 0 |
| 1 | 4800 | |

FIG. 41

| | UP | DN |
|---|---|---|
| 10TH FLOOR | | 400 |
| 9 | 0 | 0 |
| 8 | 20 | 80 |
| 7 | 80 | 40 |
| 6 | 240 | 120 |
| 5 | 240 | 80 |
| 4 | 0 | 300 |
| 3 | 80 | 40 |
| 2 | 20 | 20 |
| 1 | 0 | |

FIG. 42

| | UP | DN |
|---|---|---|
| 10TH FLOOR | | 3600 |
| 9 | 0 | 0 |
| 8 | 140 | 80 |
| 7 | 80 | 40 |
| 6 | 80 | 120 |
| 5 | 0 | 80 |
| 4 | 420 | 300 |
| 3 | 80 | 40 |
| 2 | 20 | 0 |
| 1 | 0 | |

FIG. 45
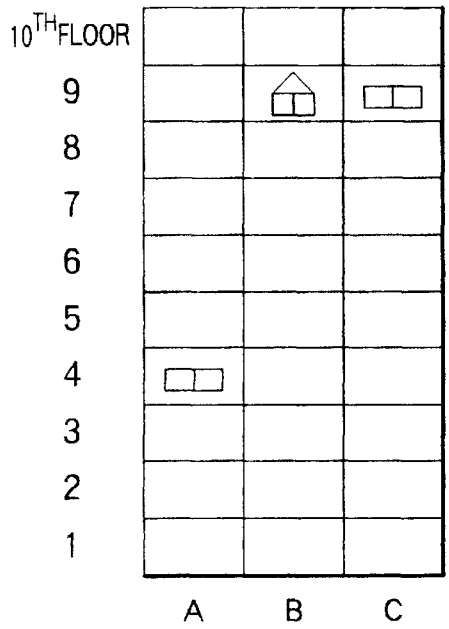
FIG. 47
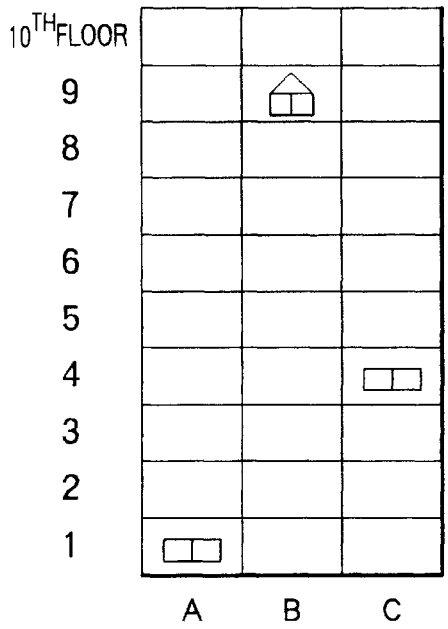
FIG. 46
| | UP | DN |
|---|---|---|
| 10TH FLOOR | | 2 |
| 9 | 0 | 0 |
| 8 | 2 | 2 |
| 7 | 4 | 4 |
| 6 | 4 | 4 |
| 5 | 2 | 4 |
| 4 | 0 | 0 |
| 3 | 2 | 2 |
| 2 | 4 | 4 |
| 1 | 6 | |
FIG. 48
| | UP | DN |
|---|---|---|
| 10TH FLOOR | | 2 |
| 9 | 0 | 4 |
| 8 | 8 | 6 |
| 7 | 6 | 6 |
| 6 | 4 | 4 |
| 5 | 2 | 2 |
| 4 | 0 | 0 |
| 3 | 2 | 2 |
| 2 | 2 | 2 |
| 1 | 0 | |

FIG. 49

| | UP | DN |
|---|---|---|
| 10TH FLOOR | | 400 |
| 9 | 0 | 0 |
| 8 | 20 | 80 |
| 7 | 80 | 40 |
| 6 | 240 | 120 |
| 5 | 240 | 80 |
| 4 | 420 | 300 |
| 3 | 80 | 80 |
| 2 | 20 | 0 |
| 1 | 0 | |

FIG. 50

| | UP | DN |
|---|---|---|
| 10TH FLOOR | | 400 |
| 9 | 0 | 0 |
| 8 | 20 | 80 |
| 7 | 80 | 40 |
| 6 | 160 | 80 |
| 5 | 60 | 40 |
| 4 | 0 | 0 |
| 3 | 40 | 20 |
| 2 | 40 | 0 |
| 1 | 1800 | |

FIG. 51

| | UP | DN |
|---|---|---|
| 10TH FLOOR | | 400 |
| 9 | 0 | 240 |
| 8 | 80 | 240 |
| 7 | 140 | 60 |
| 6 | 160 | 80 |
| 5 | 60 | 20 |
| 4 | 0 | 0 |
| 3 | 40 | 10 |
| 2 | 20 | 0 |
| 1 | 0 | |

FIG. 54

| | UP | DN |
|---|---|---|
| 10TH FLOOR | | 1600 |
| 9 | 0 | 1080 |
| 8 | 20 | 800 |
| 7 | 0 | 220 |
| 6 | 0 | 480 |
| 5 | 1260 | 260 |
| 4 | 2800 | 1400 |
| 3 | 760 | 300 |
| 2 | 360 | 0 |
| 1 | 10200 | |

FIG. 55

| | UP | DN |
|---|---|---|
| 10TH FLOOR | | 3600 |
| 9 | 0 | 1200 |
| 8 | 20 | 880 |
| 7 | 0 | 240 |
| 6 | 400 | 520 |
| 5 | 240 | 280 |
| 4 | 420 | 1500 |
| 3 | 80 | 300 |
| 2 | 20 | 0 |
| 1 | 0 | |

FIG. 56

| | UP | DN |
|---|---|---|
| 10TH FLOOR | | 3600 |
| 9 | 0 | 1200 |
| 8 | 40 | 880 |
| 7 | 60 | 240 |
| 6 | 0 | 520 |
| 5 | 180 | 280 |
| 4 | 280 | 1500 |
| 3 | 40 | 320 |
| 2 | 20 | 0 |
| 1 | 10800 | |

FIG. 59

| | UP | DN |
|---|---|---|
| 10TH FLOOR | | 100 |
| 9 | 0 | 60 |
| 8 | 5 | 20 |
| 7 | 10 | 5 |
| 6 | 20 | 10 |
| 5 | 5 | 10 |
| 4 | 10 | 25 |
| 3 | 10 | 10 |
| 2 | 5 | 0 |
| 1 | 100 | |

FIG. 60

| | UP | DN |
|---|---|---|
| 10TH FLOOR | | 2 |
| 9 | 0 | 1 |
| 8 | 2 | 2 |
| 7 | 2 | 2 |
| 6 | 2 | 2 |
| 5 | 6 | 1 |
| 4 | 7 | 2 |
| 3 | 2 | 1 |
| 2 | 2 | 0 |
| 1 | 3 | |

GROUP-CONTROLLER FOR ELEVATOR

TECHNICAL FIELD

The present invention relates to a group-supervising control system for an elevator which assigns a hall call generated by pressing a hall button to the most appropriate elevator among a plurality of elevators to make the assigned elevator serve the hall where the hall call is generated.

BACKGROUND ART

Conventionally, in a case where a plurality of cages are juxtaposed, a group-supervising operation is usually performed. One system of the group-supervising operation is an assignment system. In this system, as soon as a hall call is registered, assignment estimation values are calculated for the respective cages. A cage having the best assignment estimation value is assigned as a cage-to-serve, and only the assigned cage is made to respond to the hall call, thereby intending to enhance the service efficiency of the elevator system and to shorten the wait times of hall calls.

The assignment estimation values in the system for assigning hall calls as stated above are calculated on the basis that, assuming present circumstances to proceed as they are, which of the cages should optimally be assigned. More specifically, on the basis of cage positions and cage directions at present and hall calls and cage calls presently registered, there are obtained predicted arrival times which are predicted values of time periods required for each cage to successively respond to the hall calls and arrive at the halls of the corresponding floors, and continuation time periods which are the time period elapsed since the registrations of the hall calls. Further, the predicted arrival times and the corresponding continuation time periods are added to calculate predicted wait times with regard to all the hall calls presently registered. Then, the sum total of the predicted wait times or the sum total of the squared values of the predicted wait times is set as an assignment estimation value by an assignment estimation value calculation means, and assignment is outputted to the cage whose assignment estimation value is the minimum.

The following are examples of such a conventional system for group-supervising an elevator system:

(A) Cage positions after a predetermined time period are predicted to decide a standby floor and make an unoccupied cage stand by on the standby floor (see Japanese Patent Application Publication No. Hei 7-25491 corresponding to U.S. Pat. No. 5,058,711); and (B) Assignment and standing by are conducted in accordance with intervals between the respective cages after a predetermined time period (see Japanese Patent Application Publication No. Hei 7-72059 corresponding to U.S. Pat. No. 4,982,817).

However, the conventional systems stated above involve problems.

With the system (A), only the standby operation is taken into consideration, and thus, the system (A) is substantially effective only in off-time.

With the system (B), only the intervals between the respective cages are taken into consideration, and quantitatively servicing the respective floors is not taken into consideration, and thus, the respective floors are serviced unevenly.

The present invention is made to solve the aforementioned problems. An object of the present invention is to provide a group-supervising control system for an elevator which, by making even the time periods until the service is available with regard to the respective floors, can decrease the service unevenness, thereby carrying out efficient group supervision.

DISCLOSURE OF THE INVENTION

In order to attain the above object, according to an aspect of the present invention, a group-supervising control system for an elevator provided with a control means comprising a hall call registration means for registering a hall call based on operation of a hall button provided at a hall on each floor, an assignment estimation value calculation means for calculating assignment estimation values for selecting and assigning a cage-to-serve among a plurality of cages, and a cage assignment means for assigning the most appropriate cage among the plurality of cages based on the assignment estimation values to a hall call registered in the hall call registration means to transmit to a corresponding cage control system an assignment output for making the cage serve the hall where the hall call is generated is characterized in that the control means further comprises a cage position prediction means for predicting, based on the present cage positions, cage positions after a predetermined time period elapses, a service available time period distribution calculation means for, based on the cage positions predicted by the cage position prediction means, calculating distributions of the time periods until the service is available, that is, expected arrival times at the respective floors of a cage capable of responding to a hall call earliest, and an assignment correction value calculation means for calculating assignment correction values for correcting the assignment estimation values, based on the distributions of the time periods until the service is available, the cage assignment means correcting the assignment estimation values based on the assignment correction values to select the most appropriate cage and to transmit an assignment output.

According to another aspect of the present invention, the group-supervising control system for an elevator is characterized in that the control means further comprises a generated occupant number prediction means for predicting the number of occupants to be generated with regard to the respective floors, and a generated occupant distribution calculation means for calculating a distribution of the occupants to be generated based on the predicted numbers of occupants to be generated, the assignment correction value calculation means calculating the assignment correction values based on the distributions of the time periods until the service is available and on the distribution of the occupants to be generated.

According to another aspect of the present invention, a group-supervising control system for an elevator provided with a control means comprising a hall call registration means for registering a hall call based on operation of a hall button provided at a hall on each floor, an assignment estimation value calculation means for calculating assignment estimation values for selecting and assigning a cage-to-serve among a plurality of cages, and a cage assignment means for assigning the most appropriate cage among the plurality of cages based on the assignment estimation values to a hall call registered in the hall call registration means to transmit to a corresponding cage control system an assignment output for making the cage serve the hall where the hall call is generated is characterized in that the control means further comprises a cage position prediction means for predicting, based on the present cage positions, cage positions after a predetermined time period elapses, a service available time period distribution calculation means for, based on the cage positions predicted by the cage position prediction means, calculating distributions of the time periods until the service is available, that is, expected arrival times at the respective floors of a cage capable of responding to a hall call earliest, an unoccupied cage detection means for detecting as an unoccupied cage a cage which has responded to the whole calls and has neither a cage call nor an assigned hall call, a standby floor set means for setting, based on the distributions of the time periods until the service is available, a standby floor where an unoccupied cage is made to stand by, and a standby cage set means for setting a standby cage to stand by on the standby floor among the unoccupied cages, the cage assignment means transmitting to a corresponding cage control system a standby output for making the standby cage stand by on the standby floor.

According to another aspect of the present invention, the group-supervising control system for an elevator is characterized in that the control means further comprises a generated occupant number prediction means for predicting the number of occupants to be generated with regard to the respective floors, and a generated occupant distribution calculation means for calculating a distribution of the occupants to be generated based on the predicted numbers of occupants to be generated, the standby floor set means setting the standby floor where the unoccupied cage is made to stand by, based on the distributions of the time periods until the service is available and on the distribution of the occupants to be generated.

According to still another aspect of the present invention, a group-supervising control system for an elevator provided with a control means comprising a hall call registration means for registering a hall call based on operation of a hall button provided at a hall on each floor, an assignment estimation value calculation means for calculating assignment estimation values for selecting and assigning a cage-to-serve among a plurality of cages, and a cage assignment means for assigning the most appropriate cage among the plurality of cages based on the assignment estimation values to a hall call registered in the hall call registration means to transmit to a corresponding cage control system an assignment output for making the cage serve the hall where the hall call is generated is characterized in that the control means further comprises a cage position prediction means for predicting, based on the present cage positions, cage positions after a predetermined time period elapses, and a service available time period distribution calculation means for, based on the cage positions predicted by the cage position prediction means, calculating distributions of the time periods until the service is available, that is, expected arrival times at the respective floors of a cage capable of responding to a hall call earliest, the cage assignment means setting a deadhead cage and a deadhead floor based on the distributions of the time periods until the service is available to transmit to a corresponding cage control system a deadhead output for deadheading the set deadhead cage to the deadhead floor.

According to another aspect of the present invention, the group-supervising control system for an elevator is characterized in that the control means further comprises a generated occupant number prediction means for predicting the number of occupants to be generated with regard to the respective floors, and a generated occupant distribution calculation means for calculating a distribution of the occupants to be generated based on the predicted numbers of occupants to be generated, the cage assignment means setting the deadhead cage and the deadhead floor based on the distributions of the time periods until the service is available and on the distribution of the occupants to be generated.

According to still another aspect of the present invention, a group-supervising control system for an elevator provided with a control means comprising a hall call registration means for registering a hall call based on operation of a hall button provided at a hall on each floor, an assignment estimation value calculation means for calculating assignment estimation values for selecting and assigning a cage-to-serve among a plurality of cages, and a cage assignment means for assigning the most appropriate cage among the plurality of cages based on the assignment estimation values to a hall call registered in the hall call registration means to transmit to a corresponding cage control system an assignment output for making the cage serve the hall where the hall call is generated is characterized in that the control means further comprises a generated occupant number prediction means for predicting the number of occupants to be generated with regard to the respective floors, a generated occupant distribution calculation means for calculating a distribution of the occupants to be generated based on the predicted numbers of occupants to be generated, a cage stay time calculation means for calculating cage stay times of the respective cages with regard to the respective floors, and an assignment correction value calculation means for calculating assignment correction values for correcting the assignment estimation values based on the distribution of the occupants to be generated and on the cage stay times of the respective cages with regard to the respective floors, the cage assignment means correcting the assignment estimation values based on the assignment correction values to select the most appropriate cage and to transmit an assignment output.

According to still another aspect of the present invention, a group-supervising control system for an elevator provided with a control means comprising a hall call registration means for registering a hall call based on operation of a hall button provided at a hall on each floor, an assignment estimation value calculation means for calculating assignment estimation values for selecting and assigning a cage-to-serve among a plurality of cages, and a cage assignment means for assigning the most appropriate cage among the plurality of cages based on the assignment estimation values to a hall call registered in the hall call registration means to transmit to a corresponding cage control system an assignment output for making the cage serve the hall where the hall call is generated is characterized in that the control means further comprises an unoccupied cage detection means for detecting as an unoccupied cage a cage which has responded to the whole calls and has neither a cage call nor an assigned hall call, a generated occupant number prediction means for predicting the number of occupants to be generated with regard to the respective floors, a generated occupant distribution calculation means for calculating a distribution of the occupants to be generated based on the predicted numbers of occupants to be generated, a cage stay time calculation means for calculating cage stay times of the respective cages with regard to the respective floors, a standby floor set means for setting a standby floor where an unoccupied cage is made to stand by based on the distribution of the occupants to be generated and on the cage stay times of the respective cages with regard to the respective floors, and a standby cage set means for setting a standby cage to stand by on the standby floor among the unoccupied cages, the cage assignment means transmitting to a corresponding cage control system a standby output for making the standby cage stand by on the standby floor.

According to still another aspect of the present invention, a group-supervising control system for an elevator provided with a control means comprising a hall call registration means for registering a hall call based on operation of a hall button provided at a hall on each floor, an assignment estimation value calculation means for calculating assignment estimation values for selecting and assigning a cage-to-serve among a plurality of cages, and a cage assignment means for assigning the most appropriate cage among the plurality of cages based on the assignment estimation values to a hall call registered in the hall call registration means to transmit to a corresponding cage control system an assignment output for making the cage serve the hall where the hall call is generated is characterized in that the control means further comprises a generated occupant number prediction means for predicting the number of occupants to be generated with regard to the respective floors, a generated occupant distribution calculation means for calculating a distribution of the occupants to be generated based on the predicted numbers of occupants to be generated, and a cage stay time calculation means for calculating cage stay times of the respective cages with regard to the respective floors, the cage assignment means setting a deadhead cage and a deadhead floor based on the distribution of the occupants to be generated and on the cage stay times of the respective cages with regard to the respective floors to transmit to a corresponding cage control system a deadhead output for deadheading the set deadhead cage to the deadhead floor.

BRIEF DESCRIPTION OF THE DRAWINGS

FIG. 8 is an explanatory view of time periods until a cage A can respond to the respective floors according to Embodiments 1 and 4 of the present invention.

FIG. 9 is an explanatory view of time periods until a cage B can respond to the respective floors according to Embodiments 1 and 4 of the present invention.

FIG. 10 is an explanatory view of time periods until a cage C can respond to the respective floors according to Embodiments 1 and 4 of the present invention.

FIG. 11 is an explanatory view of time periods until the service is available with regard to the respective floors according to Embodiments 1 and 4 of the present invention.

FIG. 12 is an explanatory view of time periods until the service is available with regard to the respective floors according to Embodiments 1 and 4 of the present invention.

FIG. 13 is an explanatory view of time periods until the service is available with regard to the respective floors according to Embodiments 1 and 4 of the present invention.

FIG. 18 is an explanatory view of time periods until a cage A can respond to the respective floors according to Embodiments 2 and 5 of the present invention.

FIG. 19 is an explanatory view of time periods until a cage B can respond to the respective floors according to Embodiments 2 and 5 of the present invention.

FIG. 20 is an explanatory view of time periods until a cage C can respond to the respective floors according to Embodiments 2 and 5 of the present invention.

FIG. 21 is an explanatory view of time periods until the service is available with regard to the respective floors according to Embodiments 2 and 5 of the present invention.

FIG. 22 is an explanatory view of a relationship between calls and cage positions according to Embodiments 2 and 5 of the present invention.

FIG. 23 is an explanatory view of time periods until the service is available with regard to the respective floors according to Embodiment 2 of the present invention.

FIG. 24 is an explanatory view of a relationship between calls and cage positions according to Embodiment 2 of the present invention.

FIG. 25 is an explanatory view of time periods until the service is available with regard to the respective floors according to Embodiment 2 of the present invention.

FIG. 28 is an explanatory view of a relationship between calls and cage positions according to Embodiments 3, 6, and 9 of the present invention.

FIG. 29 is an explanatory view of a relationship between calls and cage positions according to Embodiments 3, 6, and 9 of the present invention.

FIG. 30 is an explanatory view of time periods until a cage A can respond to the respective floors according to Embodiments 3 and 6 of the present invention.

FIG. 31 is an explanatory view of time periods until a cage B can respond to the respective floors according to Embodiments 3 and 6 of the present invention.

FIG. 32 is an explanatory view of time periods until the service is available with regard to the respective floors according to Embodiments 3 and 6 of the present invention.

FIG. 33 is an explanatory view of a relationship between calls and cage positions according to Embodiments 3 and 6 of the present invention.

FIG. 34 is an explanatory view of time periods until the service is available with regard to the respective floors according to Embodiments 3 and 6 of the present invention.

FIG. 35 is an explanatory view of a relationship between calls and cage positions according to Embodiments 3 and 6 of the present invention.

FIG. 36 is an explanatory view of time periods until the service is available with regard to the respective floors according to Embodiments 3 and 6 of the present invention.

FIG. 39 is an explanatory view of the number of occupants to be generated with regard to the respective floors according to Embodiments 4 to 9 of the present invention.

FIG. 40 is an explanatory view of total wait times with regard to the respective floors according to Embodiment 4 of the present invention.

FIG. 41 is an explanatory view of total wait times with regard to the respective floors according to Embodiment 4 of the present invention.

FIG. 42 is an explanatory view of total wait times with regard to the respective floors according to Embodiment 4 of the present invention.

FIG. 45 is an explanatory view of a relationship between calls and cage positions according to Embodiment 5 of the present invention.

FIG. 46 is an explanatory view of time periods until the service is available with regard to the respective floors according to Embodiment 5 of the present invention.

FIG. 47 is an explanatory view of a relationship between calls and cage positions according to Embodiment 5 of the present invention.

FIG. 48 is an explanatory view of time periods until the service is available with regard to the respective floors according to Embodiment 5 of the present invention.

FIG. 49 is an explanatory view of total wait times with regard to the respective floors according to Embodiment 5 of the present invention.

FIG. 50 is an explanatory view of total wait times with regard to the respective floors according to Embodiment 5 of the present invention.

FIG. 51 is an explanatory view of total wait times with regard to the respective floors according to Embodiment 5 of the present invention.

FIG. 54 is an explanatory view of total wait times with regard to the respective floors according to Embodiment 6 of the present invention.

FIG. 55 is an explanatory view of total wait times with regard to the respective floors according to Embodiment 6 of the present invention.

FIG. 56 is an explanatory view of total wait times with regard to the respective floors according to Embodiment 6 of the present invention.

FIG. 59 is an explanatory view of cage stay times with regard to the respective floors according to Embodiments 7 to 9 of the present invention.

FIG. 60 is an explanatory view of cage stay ratios with regard to the respective floors according to Embodiments 7 to 9 of the present invention.

BEST MODE FOR CARRYING OUT THE INVENTION

Figure 1:
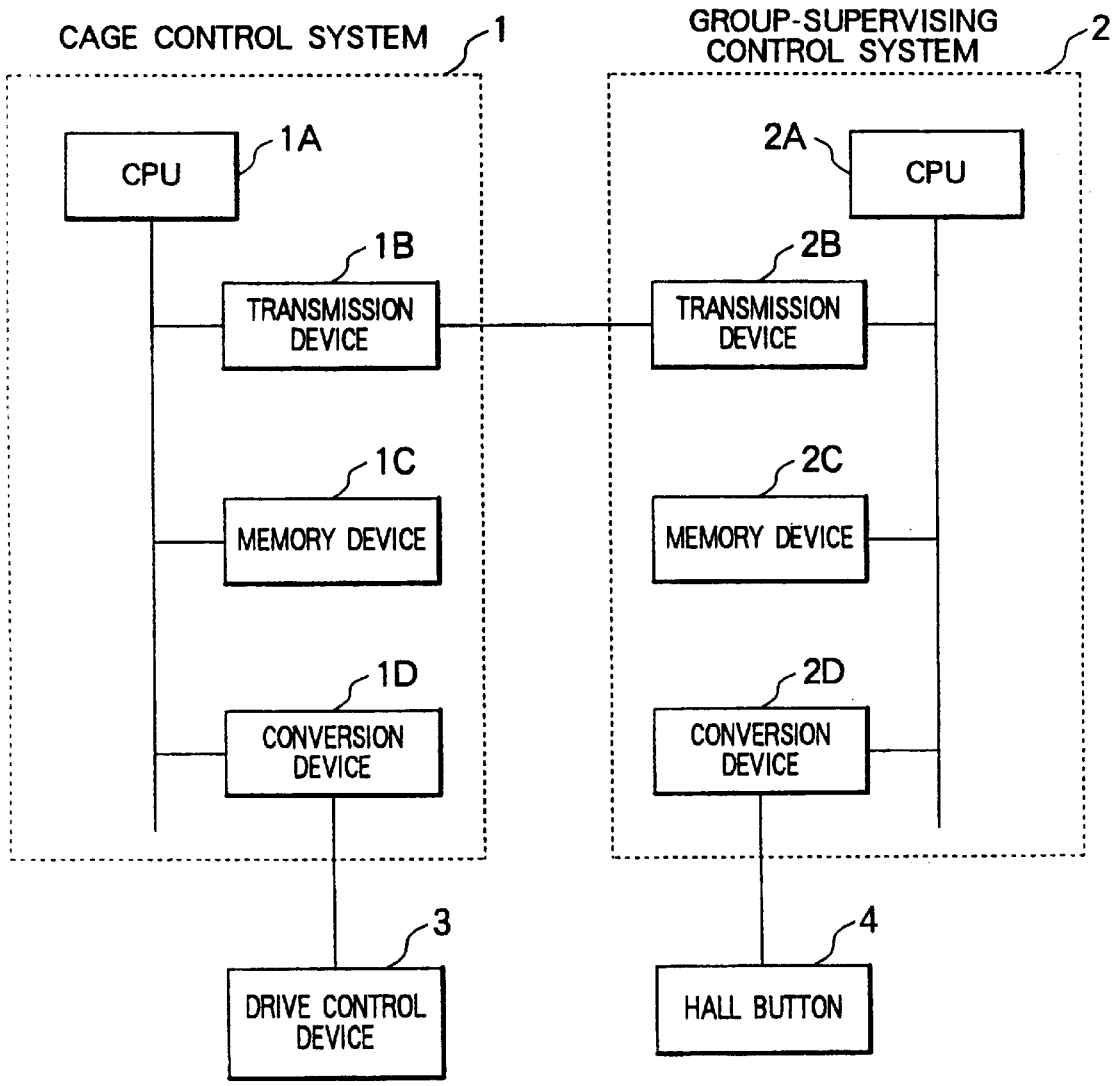
FIG. 1 is a basic block diagram illustrating a group-supervising control system for an elevator according to the present invention.

FIG. 1 is a basic block diagram illustrating a group-supervising control system for an elevator according to the present invention.

As shown in FIG. 1, a group-supervising control system 2 for group-supervising a plurality of cages is connected with a cage control system 1 for controlling a cage to transmit and receive data. The group-supervising control system 2 calculates assignment estimation values for selecting and assigning a cage-to-serve among the plurality of cages based on a hall call registration by operation of a hall button 4, and transmits to a corresponding cage control system 1 an assignment output for making the cage serve the hall where the hall call is generated. It is to be noted that, though only one cage control system 1 is shown connected with the group-supervising control system 2, actually a plurality of such cage control systems 1 are connected with the group-supervising control system 2.

The cage control system 1 is formed of a microcomputer comprising as its internal construction a central processing unit (hereinafter referred to as a CPU) 1A, a transmission device 1B for transmitting data to and receiving data from the group-supervising control system 2, a memory device 1C for storing programs and data, and a conversion device 1D for converting signal levels of input/output. The conversion device 1D is connected with a drive control device 3.

The group-supervising control system 2 is also formed of a microcomputer comprising as its internal construction a CPU 2A, a transmission device 2B for transmitting data to and receiving data from the cage control system 1, a memory device 2C for storing programs and data, and a conversion device 2D for converting signal levels of input/output. The conversion device 2D is connected with the hall button 4.

Embodiment 1

Figure 2:
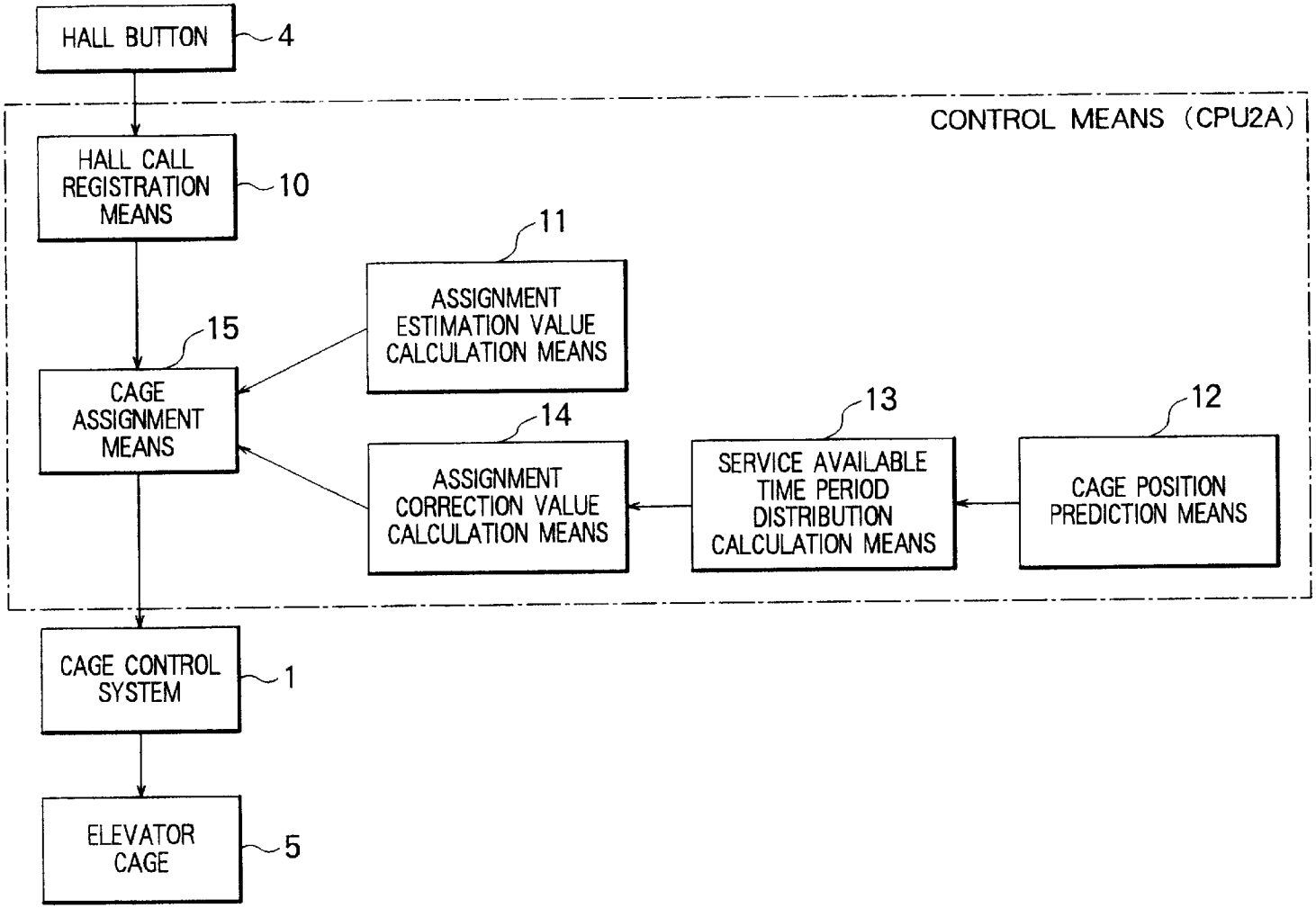
FIG. 2 explains a group-supervising control system for an elevator according to Embodiment 1 of the present invention and is a block diagram illustrating as blocks controlling functions of a CPU 2A as a control means of the group-supervising control system 2 illustrated in FIG. 1.

FIG. 2 explains a group-supervising control system for an elevator according to Embodiment 1 of the present invention and is a block diagram illustrating as blocks controlling functions of the CPU 2A as the control means of the group-supervising control system 2 illustrated in FIG. 1.

In FIG. 2, a numeral 10 denotes a known hall call registration means for registering a hall call based on operation of the hall button 4 provided at a hall on a floor. A numeral 11 denotes a known assignment estimation value calculation means for finding, on the basis of cage positions and cage directions at present and hall calls and cage calls presently registered, predicted arrival times required for each cage to successively respond to the hall calls and arrive at the halls of the corresponding floors, and continuation time periods elapsed since the registrations of the hall calls, adding the predicted arrival times to the continuation time periods to calculate predicted wait times of all the hall calls presently registered, and setting the sum total of the predicted wait times or the sum total of the squared values of the predicted wait times as an assignment estimation value. A numeral 12 denotes a known cage position prediction means for predicting, based on the present cage positions, cage positions after a predetermined time period elapses.

Further, a numeral 13 denotes a service available time period distribution calculation means for, based on the cage positions predicted by the cage position prediction means 12, calculating distributions of the time periods until the service is available, that is, expected arrival times at the respective floors of a cage capable of responding to a hall call earliest. A numeral 14 denotes an assignment correction value calculation means for calculating assignment correction values for correcting the assignment estimation values based on the distributions of the time periods until the service is available calculated by the service available time period distribution calculation means 13. A numeral 15 denotes a cage assignment means for selecting and assigning a cage whose assignment estimation value is the minimum as the most appropriate cage based on the hall calls registered by the hall call registration means 10, the assignment estimation values calculated by the assignment estimation value calculation means 11, and the assignment correction values calculated by the assignment correction value calculation means 14. The cage control system 1 of the cage which receives an assignment output from the cage assignment means 15 responds to it by controlling an elevator cage 5 including the corresponding drive control device 3.

When a hall button is pressed, similarly to a conventional one, the group-supervising control system for an elevator according to Embodiment 1 of the present invention constructed as above assigns the generated hall call to the most appropriate elevator among a plurality of elevators and makes the assigned elevator serve the hall where the hall call is generated, but differs from a conventional one on the following point.

Figure 3:
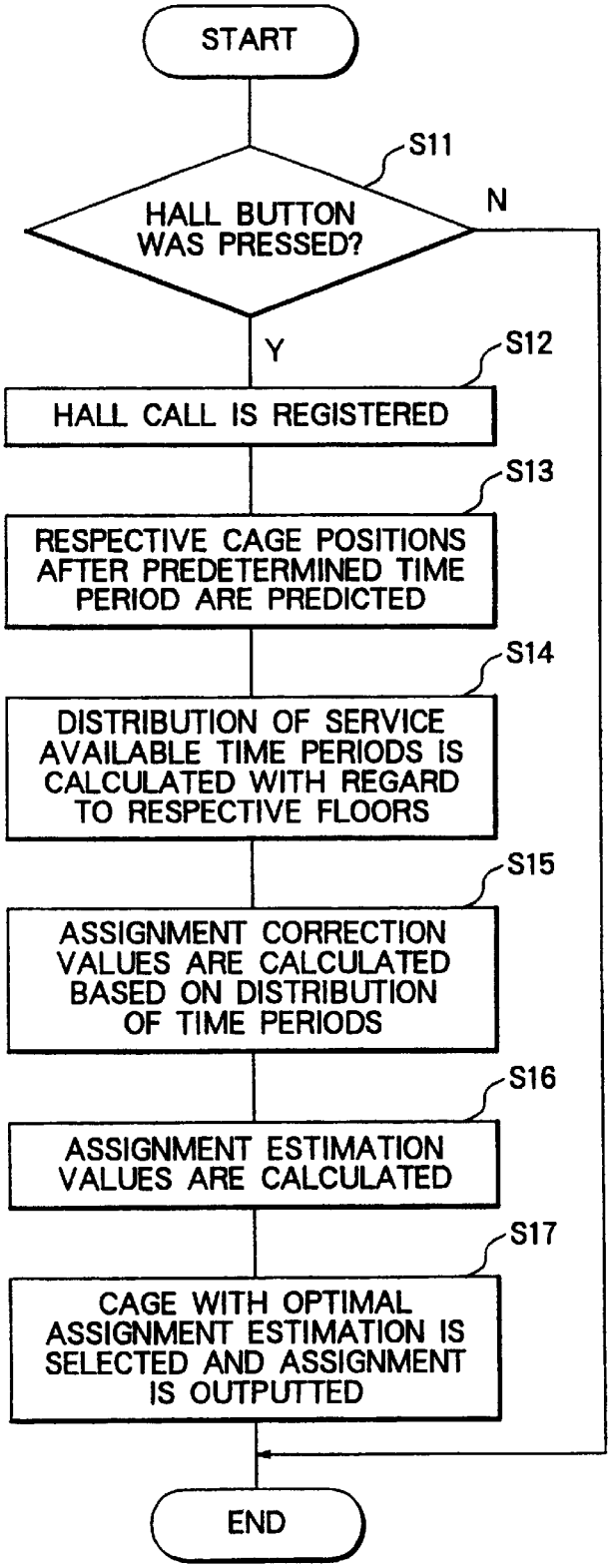
FIG. 3 explains operation of Embodiment 1 of the present invention and is a flow chart illustrating the controlling functions of the CPU 2A as the control means of the group-supervising control system 2 illustrated in FIG. 1.

More specifically, novel operation according to Embodiment 1 constructed as above is now described according to a flow chart shown as FIG. 3 as the content of the controlling functions by the CPU 2A with reference to FIGS. 4 to 7 illustrating relationships between calls and cage positions, FIGS. 8 to 10 which are explanatory views of time periods until cages can respond to the respective floors, and FIGS. 11 to 13 which are explanatory views of time periods until the service is available with regard to the respective floors.

Figure 4:
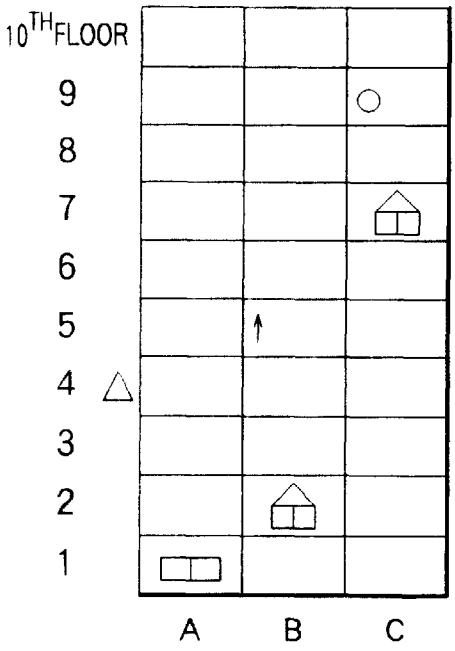
FIG. 4 is an explanatory view of a relationship between calls and cage positions according to Embodiments 1, 4, and 7 of the present invention.

The assignment operation is described taking as an example a case where, as shown in FIG. 4, there are cages A, B, and C as the elevator cages 5 to be group-supervised, the cage A standing by with its door closed on the first floor, the cage B travelling upward having an UP assignment on the fifth floor as shown by an arrow, and the cage C travelling upward having a cage call on the ninth floor as shown by a circle, and a hall call in the UP direction is registered on the fourth floor as shown by a triangle.

In the flow chart shown in FIG. 3, first, at Step S11, whether the hall button 4 was pressed or not is checked. In the case where the hall button 4 was not pressed, nothing is conducted and the process ends. In the case where the hall button 4 was pressed, the process proceeds to Step S12, where a hall call is registered by the hall call registration means 10. After the hall call is registered, the process proceeds to Step S13, where the cage position prediction means 12 predicts, based on the present cage positions of the respective cages, cage positions after a predetermined time period elapses in the case where the hall call in the UP direction on the fourth floor is tentatively assigned to the cages A–C, respectively.

Figure 6:
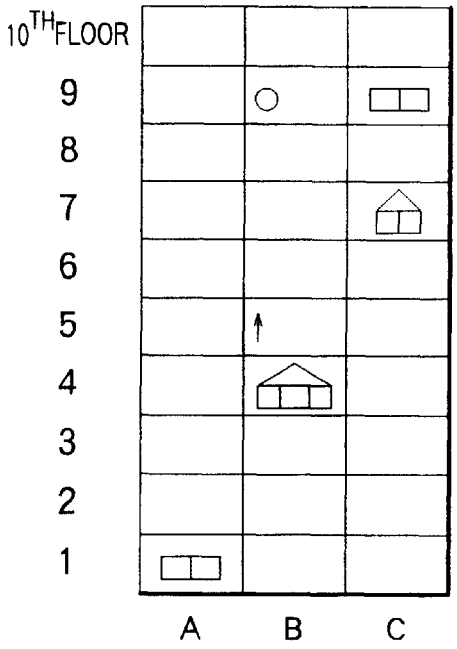
FIG. 6 is an explanatory view of a relationship between calls and cage positions according to Embodiments 1, 4, and 7 of the present invention.
Figure 5:
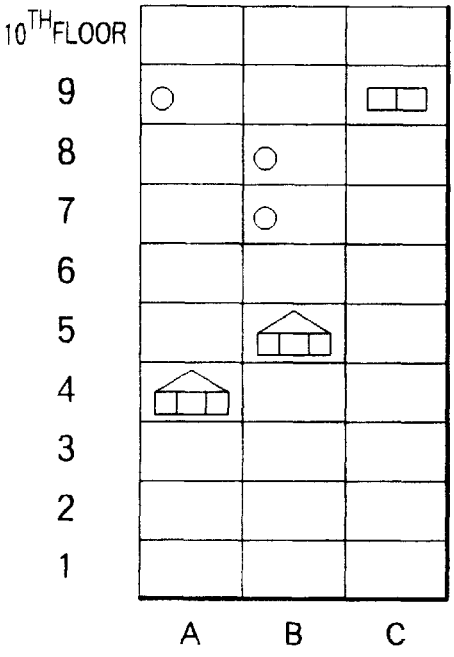
FIG. 5 is an explanatory view of a relationship between calls and cage positions according to Embodiments 1, 4, and 7 of the present invention.
Figure 7:
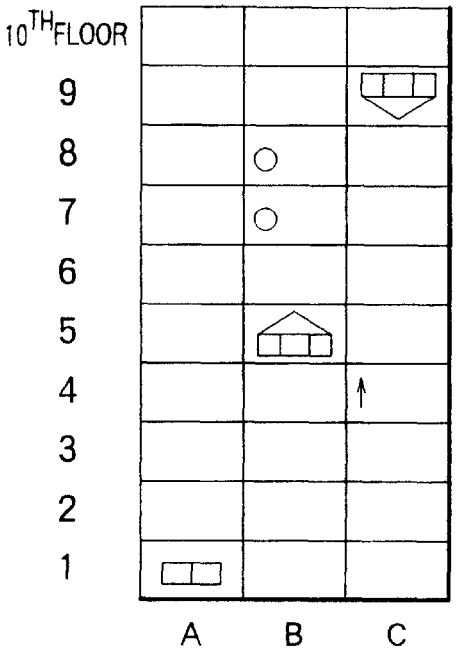
FIG. 7 is an explanatory view of a relationship between calls and cage positions according to Embodiments 1, 4, and 7 of the present invention.

For example, the cage positions of the cages A–C after the predetermined time period (in the case where the predetermined time period is 10 seconds) in the case where the hall call in the UP direction on the fourth floor is tentatively assigned to the cage A are shown in FIG. 5. Similarly, the cage positions after the predetermined time period in the case where the cage B is tentatively assigned are shown in FIG. 6, and the cage positions after the predetermined time period in the case where the cage C is tentatively assigned are shown in FIG. 7.

After the cage positions are predicted as described in the above, the process proceeds to Step S14, where the service available time period distribution calculation means 13 calculates the time periods until the service is available (arrival times of a cage capable of responding earliest) with regard to the respective floors. The time periods until a cage can respond are calculated assuming by way of example that a cage expends 2 seconds in advancing a distance of one floor and 10 seconds on one stop, and that the cage is sequentially driven up and down throughout all the floors, and that, regarding a cage assigned no direction, the cage travels from the floor where the cage is positioned directly to the respective floors.

In the case where the time periods until the respective cages can respond when the cages are positioned as shown in FIG. 5 is calculated with regard to this condition, the time periods until the cages A, B, and C can respond to the respective floors are shown in FIGS. 8, 9, and 10, respectively.

The distribution of the time periods until the service is available with regard to the respective floors calculated based on the above results is shown in FIG. 11. Similarly, the distributions of the time periods until the service is available with regard to the respective floors as for FIGS. 6 and 7 are shown in FIGS. 12 and 13, respectively.

After the distributions of the time periods until the service is available are calculated, the process proceeds to Step S15, where the respective maximum time periods are taken out from the time periods until the service is available calculated by the assignment correction value calculation means 14, and are made to be assignment correction values of the respective cages. In this case, the assignment correction values with regard to the cages A, B, and C are 16, 8, and 18, respectively.

After the assignment correction values are calculated at Step S15, the process proceeds to Step S16, where the assignment estimation values with regard to the respective cages are calculated by the assignment estimation value calculation means 11. More specifically, as known, the assignment estimation values are calculated by finding, based on the cage positions and the cage directions at present and the hall calls and the cage calls presently registered, the predicted arrival times required for each cage to successively respond to the hall calls and arrive at the halls of the corresponding floors, and the continuation time periods elapsed since the registrations of the hall calls, adding the predicted arrival times to the continuation time periods to calculate predicted wait times of all the hall calls presently registered, and calculating the sum total of the predicted wait times or the sum total of the squared values of the predicted wait times as an assignment estimation values.

After the assignment estimation values are calculated at Step S16, the process proceeds to Step S17, where the cage assignment means 15 adds the assignment correction values to the assignment estimation values, respectively, selects a cage whose assignment estimation value is the minimum as the most appropriate cage, and outputs assignment. For example, when the assignment estimation values of the cages A, E, and C are 6, 10, and 20, respectively, the results of adding the corresponding assignment correction values to the respective assignment estimation values are 22, 18, and 38, respectively, and thus, the cage B is selected as the most appropriate cage and is assigned.

Therefore, according to Embodiment 1, by decreasing the time periods until the service is available with regard to the respective floors (the difference between the maximum predicted arrival time and the minimum predicted arrival time) and by making more even the time periods until the service is available with regard to the respective floors, the service unevenness is decreased and the service is improved.

Embodiment 2

Figure 14:
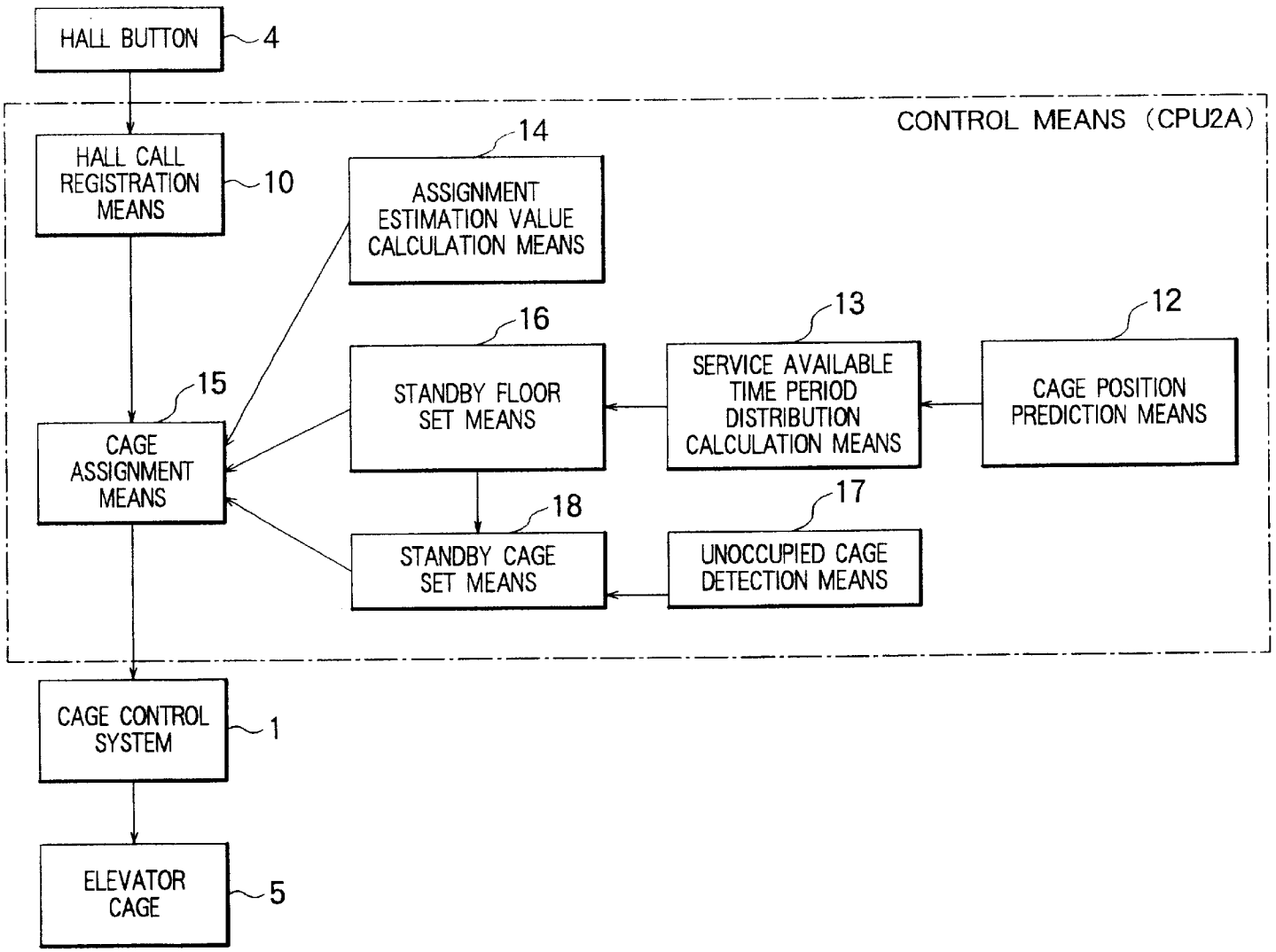
FIG. 14 explains a group-supervising control system for an elevator according to Embodiment 2 of the present invention and is a block diagram illustrating as blocks controlling functions of the CPU 2A as the control means of the group-supervising control system 2 illustrated in FIG. 1.

Next, FIG. 14 explains a group-supervising control system for an elevator according to Embodiment 2 of the present invention and is a block diagram illustrating as blocks controlling functions of the CPU 2A as the control means of the group-supervising control system 2 illustrated in FIG. 1.

In FIG. 14, the numerals identical to those of Embodiment 1 in FIG. 2 designate identical parts and the description thereof is omitted. As new numerals, a numeral 16 denotes a standby floor set means for setting, based on the distributions of the time periods until the service is available calculated by the service available time period distribution calculation means 13, a standby floor where an unoccupied cage is made to stand by, a numeral 17 denotes an unoccupied cage detection means for detecting as an unoccupied cage a cage which has neither a hall call nor a cage, and a numeral 18 denotes a standby cage set means for setting a cage to stand by on the standby floor set by the standby floor set means 16 from the unoccupied cages detected by the unoccupied cage detection means 17. The cage assignment means 15 in this embodiment transmits a standby output for making the standby cage stand by on the standby floor to a corresponding cage control system 1. The cage control system 1 of the cage which receives the standby output responds by controlling an elevator cage 5 including the corresponding drive control device 3.

Figure 15:
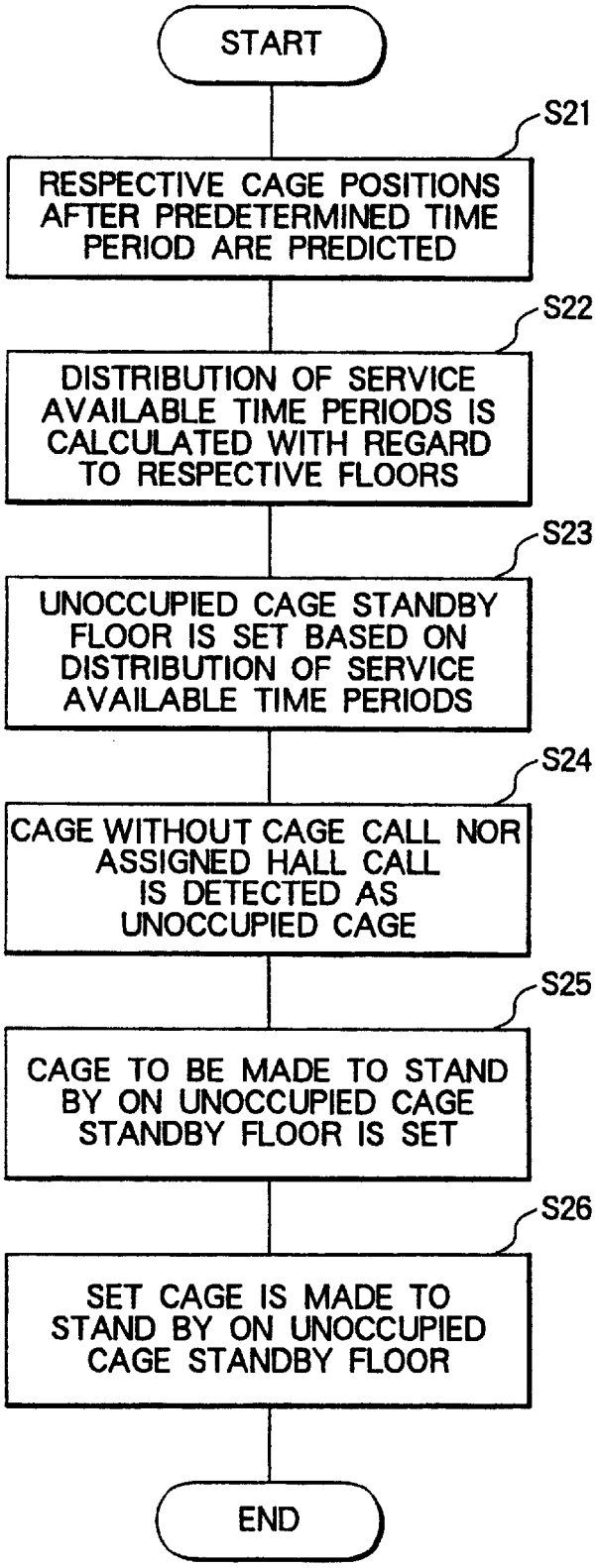
FIG. 15 explains operation of Embodiment 2 of the present invention and is a flow chart illustrating the controlling functions of the CPU 2A as the control means of the group-supervising control system 2 illustrated in FIG. 1.
Figure 16:
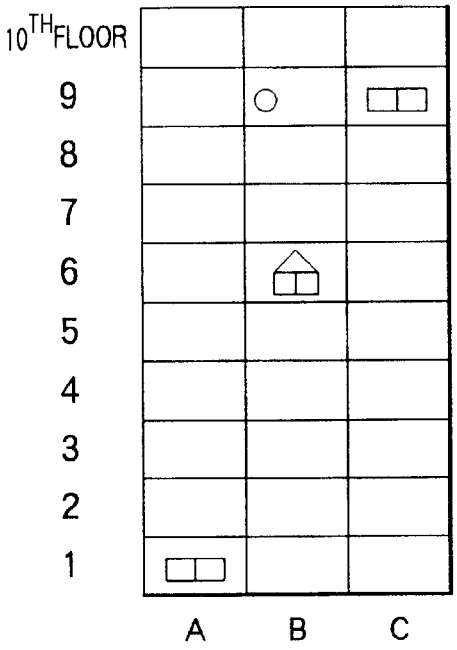
FIG. 16 is an explanatory view of a relationship between calls and cage positions according to Embodiments 2, 5, and 8 of the present invention.
Figure 17:
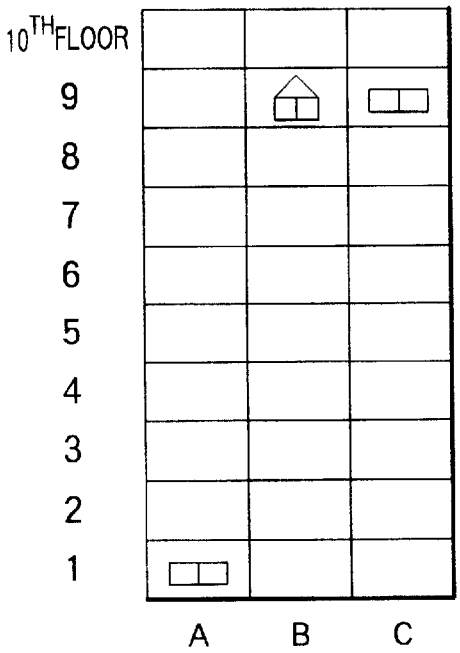
FIG. 17 is an explanatory view of a relationship between calls and cage positions according to Embodiments 2, 5, and 8 of the present invention.

Next, operation according to Embodiment 2 constructed as above is now described according to a flow chart shown in FIG. 15 as the content of the controlling functions by the CPU 2A with reference to FIGS. 16 and 17 illustrating relationships between calls and cage positions, FIGS. 18 to 20 which are explanatory views of time periods until cages can respond to the respective floors, FIG. 21 which is an explanatory view of time periods until the service is available with regard to the respective floors, FIG. 22 illustrating a relationship between calls and cage positions, FIG. 23 which is an explanatory view of time periods until the service is available with regard to the respective floors, FIG. 24 illustrating a relationship between calls and cage positions, and FIG. 25 which is an explanatory view of time periods until the service is available with regard to the respective floors.

The operation to set a standby cage and a standby floor and to make the standby cage stand by on the standby floor is described taking as an example the case where, as shown in FIG. 16, there are cages A, B, and C as the elevator cages 5 to be group-supervised, the cage A standing by with its door closed on the first floor, the cage B travelling upward having a cage call on the ninth floor as shown by a circle, and the cage C standing by with its door closed on the ninth floor.

In the flow chart shown in FIG. 15, first, at Step S21, the cage position prediction means 12 predicts, based on the present cage positions of the respective cages, cage positions after a predetermined time period elapses. For example, in the case where the predetermined time period is 10 seconds, the cage positions after 10 seconds from those shown in FIG. 16 are shown in FIG. 17.

After the cage positions are predicted, the process proceeds to Step S22, where the service available time period distribution calculation means 13 calculates the time periods until the service is available with regard to the respective floors. The time periods until a cage can respond are calculated assuming by way of example that a cage expends 2 seconds in advancing a distance of one floor and 10 seconds on one stop, and that the cage is sequentially driven up and down throughout all the floors, and that, regarding a cage assigned no direction, the cage travels from the floor where the cage is positioned directly to the respective floors.

In the case where the time periods until the respective cages can respond when the cages are positioned as shown in FIG. 17 are calculated with regard to this condition, the time periods until the cages A, B, and C can respond to the respective floors are shown in FIGS. 18, 19, and 20, respectively.

The distribution of the time periods until the service is available (arrival times of a cage capable of responding earliest) with regard to the respective floors calculated based on the above results is shown in FIG. 21.

After the distribution of the time periods until the service is available is calculated, the process proceeds to Step S23, where the standby floor set means 16 sets as an unoccupied cage standby floor the floor from which the maximum time period among the calculated time periods until the service is available is taken out. In this case, the unoccupied cage standby floor is the fifth floor.

After the unoccupied cage standby floor is set at Step S23, the process proceeds to Step S24, where the unoccupied cage detection means 17 detects as an unoccupied cage a cage which has responded to the whole calls and has neither a cage call nor an assigned hall call. In this case, the cages A and C are detected as unoccupied cages.

After the unoccupied cages are detected at Step S24, the process proceeds to Step S25, where the standby cage set means 18 sets a cage to stand by on the unoccupied cage standby floor among the unoccupied cages. The setting is conducted by calculating distributions of the time periods until the service is available with regard to the respective floors with regard to the respective cases where the respective unoccupied cages are tentatively made to stand by on the unoccupied cage standby floor, and the cage with which the maximum time period until the service is available is smaller than that in a case where the same cage is not made to stand by and is smaller than that in a case where any other cage is made to stand by is set as the standby cage. For example, in the case where the unoccupied cage A is made to stand by on the unoccupied cage standby floor, the cage positions are shown in FIG. 22, and the distribution of the time periods until the service is available is shown in FIG. 23. In the case where the unoccupied cage C is made to stand by on the unoccupied cage standby floor, the cage positions are shown in FIG. 24, and the distribution of the time periods until the service is available is shown in FIG. 25. Since the maximum lime period until the service is available in the case where the cage A is made to stand by is 8 while that in the case where the cage C is made to stand by is 6, the cage C is set as the standby cage.

After the standby cage is set at Step S25, the process proceeds to Step S26, where the unoccupied cage C set by the cage assignment means 15 is made to stand by on the fifth floor, which is the unoccupied cage standby floor.

Therefore, according to Embodiment 2, by making more even the time periods until the service is available with regard to the respective floors, the service unevenness is decreased and the service is improved.

Embodiment 3

Figure 26:
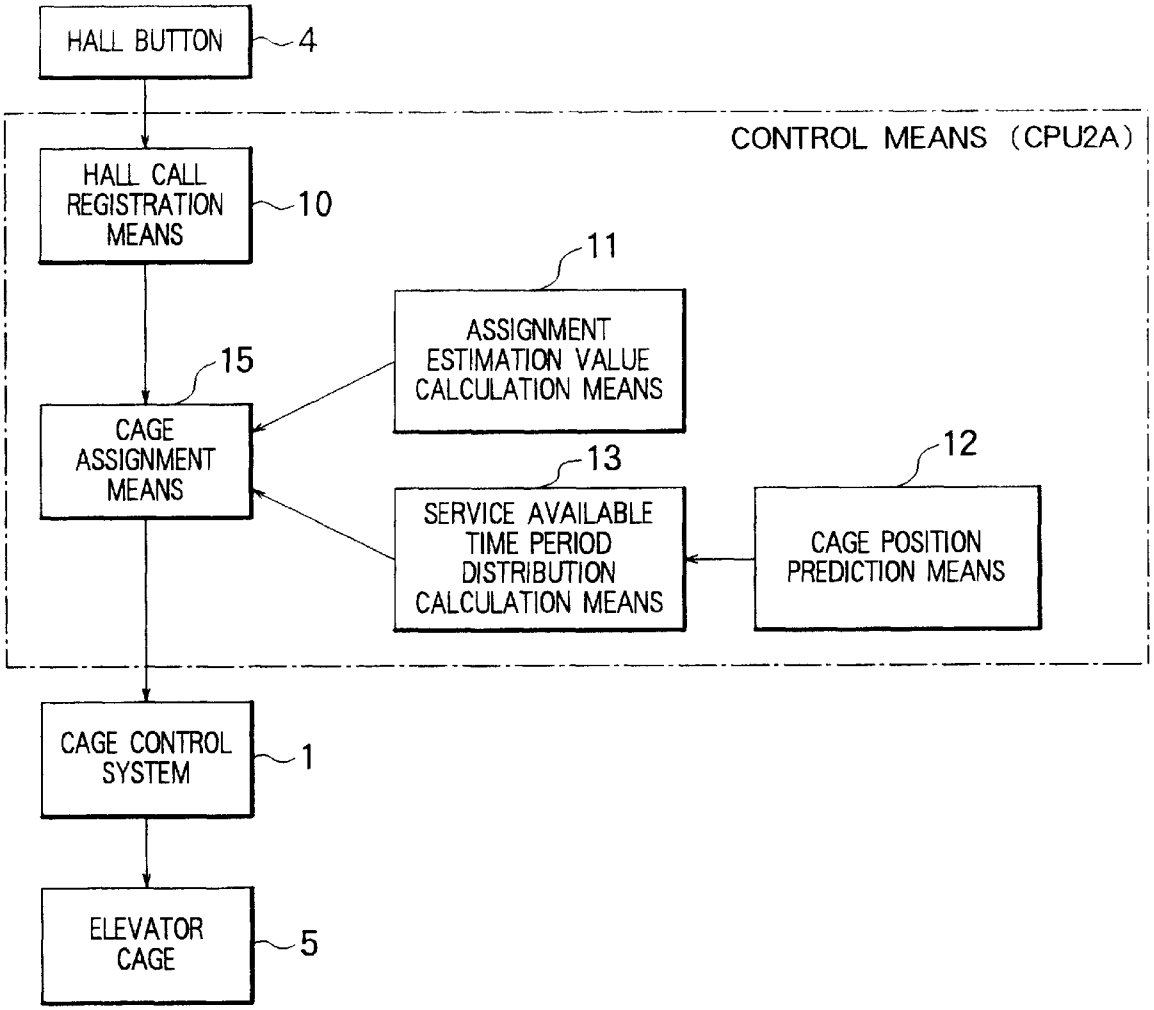
FIG. 26 explains a group-supervising control system for an elevator according to Embodiment 3 of the present invention and is a block diagram illustrating as blocks controlling functions of the CPU 2A as the control means of the group-supervising control system 2 illustrated in FIG. 1.

Next, FIG. 26 explains a group-supervising control system for an elevator according to Embodiment 3 of the present invention and is a block diagram illustrating as blocks controlling functions of the CPU 2A as the control means of the group-supervising control system 2 illustrated in FIG. 1.

In FIG. 26, the numerals identical to those of Embodiment 1 in FIG. 2 designate identical parts and the description thereof is omitted. The cage assignment means 15 in this embodiment sets a deadhead cage and a deadhead floor based on the distributions of the time periods until the service is available calculated by the service available time period distribution calculation means 13 to transmit to a corresponding cage control system 1 a deadhead output for deadheading the set deadhead cage to the deadhead floor. The cage control system 1 of the cage which receives the deadhead output responds by controlling an elevator cage 5 including the drive control device 3.

Figure 27:
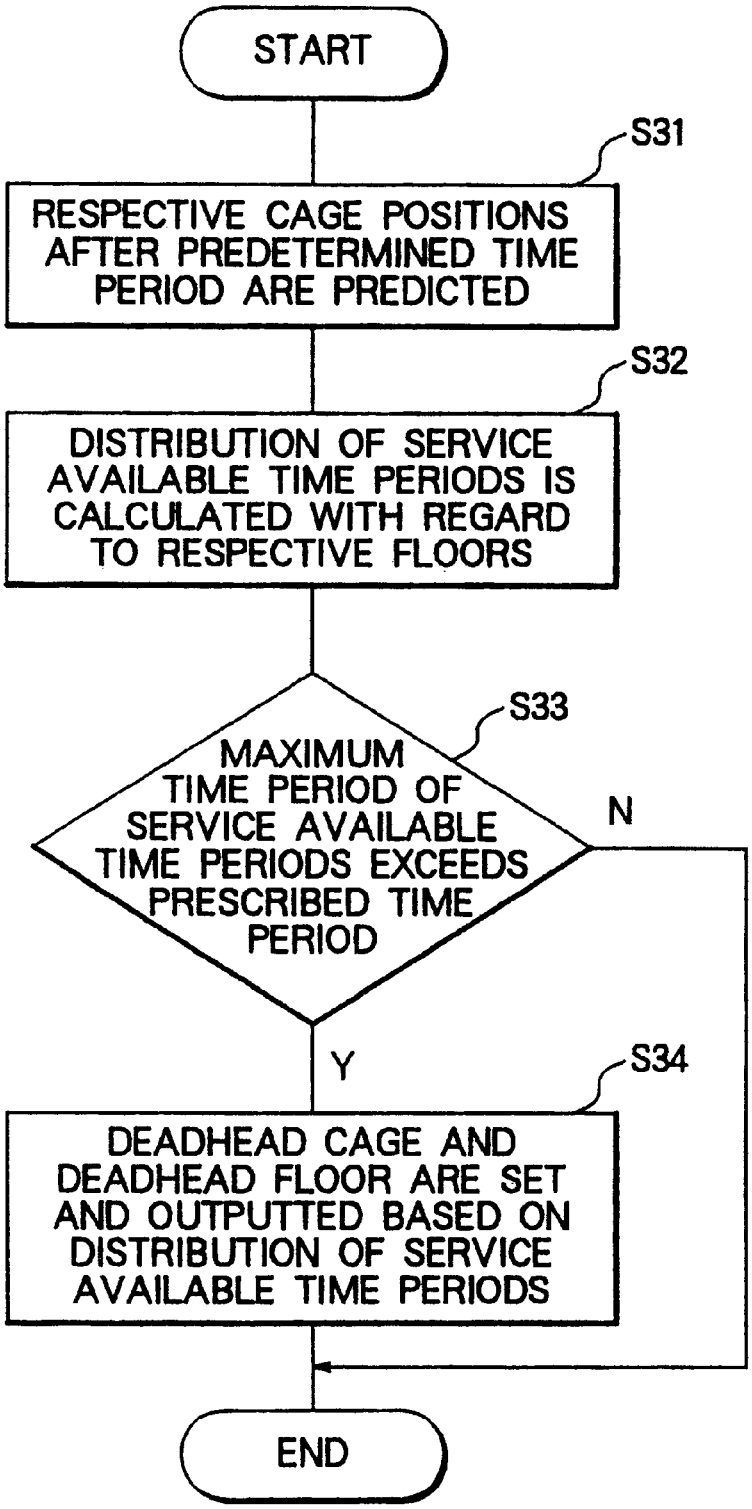
FIG. 27 explains operation of Embodiment 3 of the present invention and is a flow chart illustrating the controlling functions of the CPU 2A as the control means of the group-supervising control system 2 illustrated in FIG. 1.

Next, operation according to Embodiment 3 constructed as above is now described according to a flow chart shown as FIG. 27 as the content of the controlling functions by the CPU 2A with reference to FIGS. 28 and 29 illustrating relationships between calls and cage positions, FIGS. 30 and 31 which are explanatory views of time periods until cages can respond to the respective floors, FIG. 32 which is an explanatory view of time periods until the service is available with regard to the respective floors, FIG. 33 illustrating a relationship between calls and cage positions, FIG. 34 which is an explanatory view of time periods until the service is available with regard to the respective floors, FIG. 35 illustrating a relationship between calls and cage positions, and FIG. 36 which is an explanatory view of time periods until the service is available with regard to the respective floors.

The operation to set a deadhead cage and a deadhead floor and to forcedly make the deadhead cage stop at the deadhead floor is now described taking as an example the case where, as shown in FIG. 28, there are cages A and B as the elevator cages 5 to be group-supervised, the cage A travelling upward having a cage call on the tenth floor as shown by a circle, and the cage B travelling upward having a cage call on the ninth floor as shown by another circle.

In the flow chart shown in FIG. 27, first, at Step S31, the cage position prediction means 12 predicts, based on the present cage positions of the respective cages, cage positions after a predetermined time period elapses. For example, in the case where the predetermined time period is 10 seconds, the cage positions after 10 seconds from those shown in FIG. 28 are shown in FIG. 29.

After the cage positions are predicted at Step S31, the process proceeds to Step S32, where the service available time period distribution calculation means 13 calculates the time periods until the service is available with regard to the respective floors. The time periods until a cage can respond are calculated assuming by way of example that a cage expends 2 seconds in advancing a distance of one floor and 10 seconds on one stop, and that the cage is sequentially driven up and down throughout all the floors, and that, regarding a cage assigned no direction, the cage travels from the floor where the cage is positioned directly to the respective floors.

In the case where the time periods until the respective cages can respond when the cages are positioned as shown in FIG. 29 is calculated with regard to this condition, the time periods until the cages A and B can respond to the respective floors are shown in FIGS. 30 and 31, respectively.

The distribution of the time periods until the service is available (arrival times of a cage capable of responding earliest) with regard to the respective floors calculated based on the above results is shown in FIG. 32.

After the distribution of the time periods until the service is available is calculated at Step S32, the process proceeds to Step S33, where the cage assignment means 15 checks whether the maximum time period until the service is available exceeds a prescribed time period or not.

In the case where the maximum time period does not exceed the prescribed time period, the process ends. In the case where the maximum time period exceeds the prescribed time period, the process proceeds to Step S34, where the cage assignment means 15 sets a deadhead cage and a deadhead floor, and the deadhead cage is made to deadhead to (is forcedly made to stop at) the deadhead floor. For example, it is assumed that the deadhead floor is the floor where the cage is at present (the state shown in FIG. 28), and the deadhead cage is the cage with which, when the cage is made to deadhead to the floor, the maximum time period until the service is available after the predetermined time period elapses is smaller. For example, in the case where the cage A is made to deadhead (is forcedly made to stop), the deadhead floor is the first floor.

The cage positions after the predetermined time period (in the case where the predetermined time period is 10 seconds)

in that case are shown in FIG. 33, and the distribution of the time periods until the service is available is shown in FIG. 34. Similarly, in the case where the cage B is forcedly made to deadhead, the deadhead floor is the second floor. The cage positions after the predetermined time period in that case are shown in FIG. 35, and the distribution of the time periods until the service is available is shown in FIG. 36.

Since the maximum time period until the service is available in the case where the cage A is forcedly made to deadhead is 32 seconds while that in the case where the cage B is forcedly made to deadhead is 36 seconds, the cage A is set as the deadhead cage, and the deadhead cage A is forcedly made to stop at the deadhead floor (the first floor).

Therefore, according to Embodiment 3, by decreasing the time periods until the service is available with regard to the respective floors (the difference between the maximum predicted arrival time and the minimum predicted arrival time) and by making more even the time periods until the service is available with regard to the respective floors, the service unevenness is decreased and the service is improved.

Embodiment 4

Figure 37:
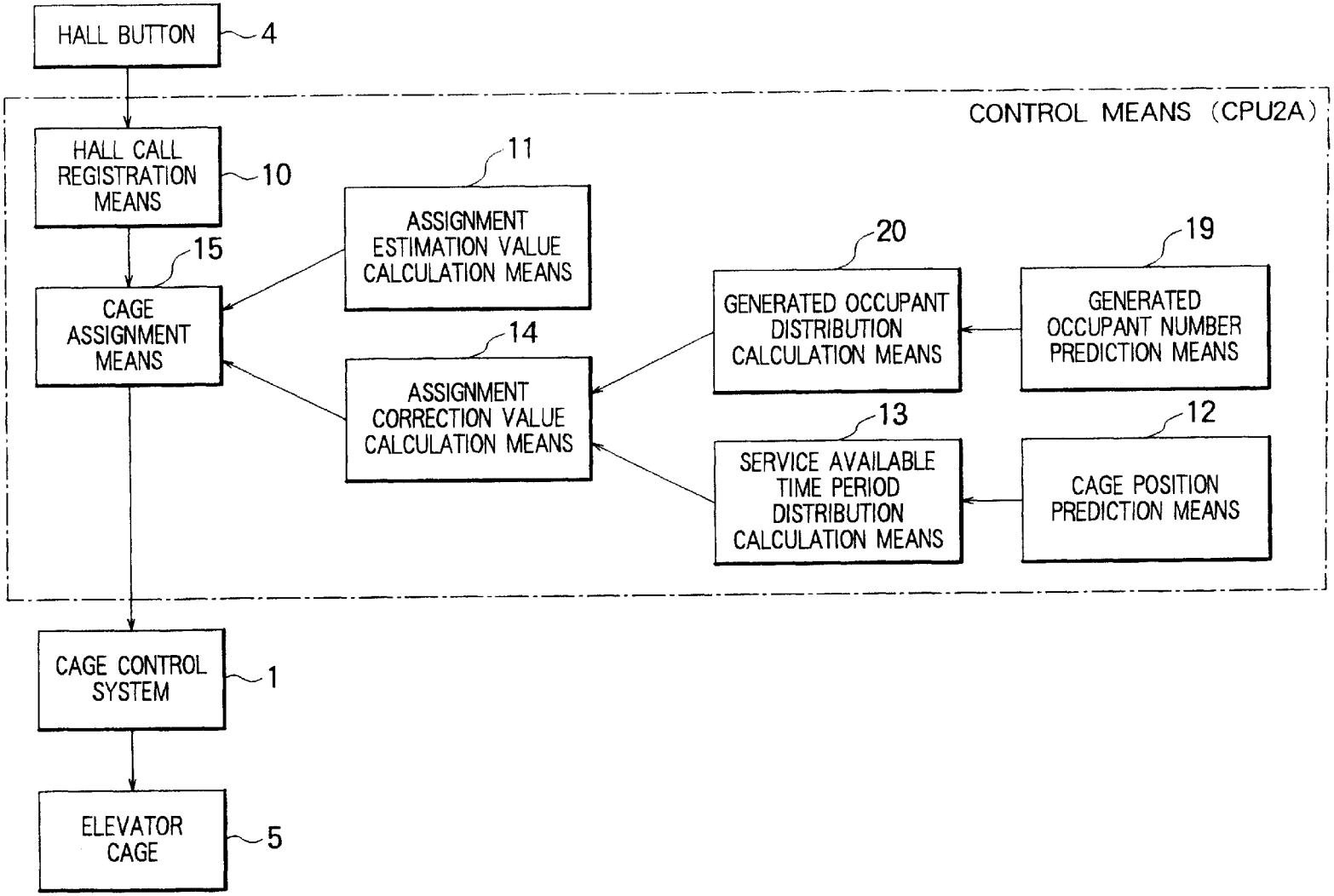
FIG. 37 explains a group-supervising control system for an elevator according to Embodiment 4 of the present invention and is a block diagram illustrating as blocks controlling functions of the CPU 2A as the control means of the group-supervising control system 2 illustrated in FIG. 1.

Next, FIG. 37 explains a group-supervising control system for an elevator according to Embodiment 4 of the present invention and is a block diagram illustrating as blocks controlling functions of the CPU 2A as the control means of the group-supervising control system 2 illustrated in FIG. 1.

In FIG. 37, the numerals identical to those of Embodiment 1 in FIG. 2 designate identical parts and the description thereof is omitted. As new numerals, a numeral 19 denotes a generated occupant number prediction means for predicting the number of occupants to be generated with regard to the respective floors, and a numeral 20 denotes a generated occupant distribution calculation means for calculating a distribution of the occupants to be generated based on the predicted numbers of occupants to be generated by the generated occupant number prediction means 19.

The assignment correction value calculation means 14 in Embodiment 4 calculates the assignment correction values for correcting the assignment estimation values based on the distributions of the time periods until the service is available calculated by the service available time period distribution calculation means 13 and on the distribution of the occupants to be generated calculated by the generated occupant distribution calculation means 20. The cage assignment means 15 selects and assigns a cage whose assignment estimation value is the minimum as the most appropriate cage based on the hall calls registered by the hall call registration means 10, the assignment estimation values calculated by the assignment estimation value calculation means 11, and the assignment correction values calculated by the assignment correction value calculation means 14. The cage control system 1 of the cage which receives an assignment output from the cage assignment means 15 responds to it and controls an elevator cage 5 including the corresponding drive control device 3.

Figure 38:
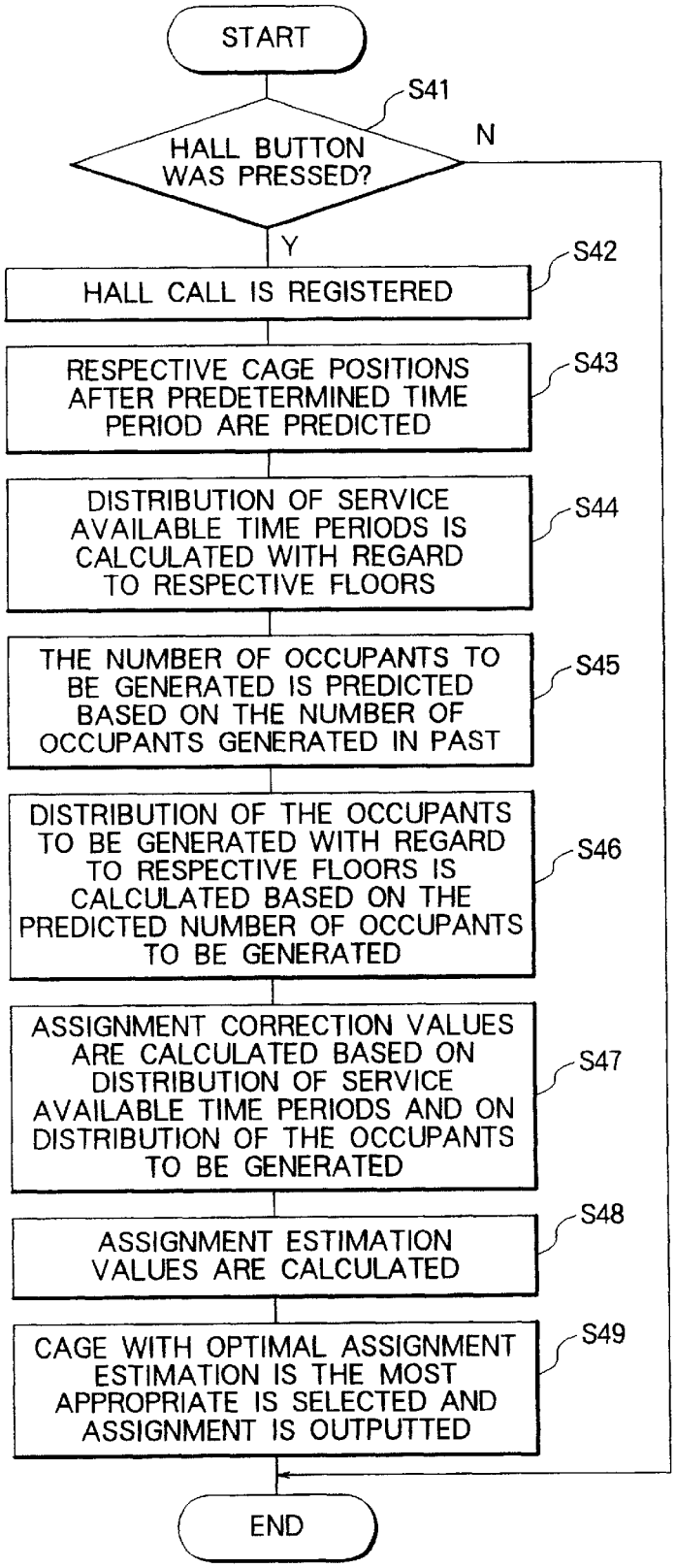
FIG. 38 explains operation of Embodiment 4 of the present invention and is a flow chart illustrating the controlling functions of the CPU 2A as the control means of the group-supervising control system 2 illustrated in FIG. 1.

Next, operation according to Embodiment 4 constructed as above is now described according to a flow chart shown in FIG. 38 as the content of the controlling functions by the CPU 2A with reference to FIGS. 4 to 7 illustrating relationships between calls and cage positions, FIGS. 8 to 10 which are explanatory views of time periods until cages can respond to the respective floors, FIGS. 11 to 13 which are explanatory views of time periods until the service is available with regard to the respective floors, FIG. 39 which is an explanatory view of numbers of occupants to be generated with regard to the respective floors, and FIGS. 40 to 42 which are explanatory views of total wait times with regard to the respective floors.

The assignment operation is described taking as an example a case where, as shown in FIG. 4, there are cages A, B, and C as the elevator cages 5 to be group-supervised, the cage A standing by with its door closed on the first floor, the cage B travelling up having an UP assignment on the fifth floor as shown by an arrow, and the cage C travelling up having a cage call on the ninth floor as shown by a circle, and a hall call in the UP direction is registered on the fourth floor as shown by a triangle.

In the flow chart shown in FIG. 38, first, at Step S41, whether the hall button 4 was pressed or not is checked. In the case where the hall button 4 was not pressed, nothing is conducted and the process ends. In the case where the hall button 4 was pressed, the process proceeds to Step S42, where a hall call is registered by the hall call registration means 10.

After the hall call is registered at Step S42, the process proceeds to Step S43, where the cage position prediction means 12 predicts, based on the present cage positions of the respective cages, cage positions after a predetermined time period elapses in the case where the hall call in the UP direction on the fourth floor is tentatively assigned to the cages A–C, respectively.

For example, the cage positions of the cages A–C after the predetermined time period (in the case where the predetermined time period is 10 seconds) in the case where the hall call in the UP direction on the fourth floor is tentatively assigned to the cage A are shown in FIG. 5. Similarly, the cage positions after the predetermined time period in the case where the cage B is tentatively assigned are shown in FIG. 6, and the cage positions after the predetermined time period in the case where the cage C is tentatively assigned are shown in FIG. 7.

After the cage positions are predicted as described in the above, the process proceeds to Step S44, where the service available time period distribution calculation means 13 calculates the time periods until the service is available (arrival times of a cage capable of responding earliest) with regard to the respective floors. The time periods until a cage can respond are calculated assuming by way of example that a cage expends 2 seconds in advancing a distance of one floor and 10 seconds on one stop, and that the cage is sequentially driven up and down throughout all the floors, and that, regarding a cage of no direction, the cage travels from the floor where the cage is positioned directly to the respective floors.

In the case where the time periods until the respective cages can respond when the cages are positioned as shown in FIG. 5 are calculated with regard to this case, the time periods until the cages A, B, and C can respond to the respective floors are shown in FIGS. 8, 9, and 10, respectively.

The distribution of the time periods until the service is available with regard to the respective floors calculated based on the above results is shown in FIG. 11. Similarly, the distributions of the time periods until the service is available with regard to the respective floors as for FIGS. 6 and 7 are shown in FIGS. 12 and 13, respectively.

After the distributions of the time periods until the service is available are calculated, the process proceeds to Step S25, where the generated occupant number prediction means 19 predicts the number of occupants to be generated in the future based on the number of occupants generated in the past with regard to the respective floors. For example, if the number of occupants generated yesterday was as shown in FIG. 39, the number of occupants to be generated today is predicted to be the same as those yesterday, and the number of occupants to be generated is, similarly to those yesterday, shown in FIG. 39.

After the number of occupants to be generated is predicted at Step S45, the process proceeds to Step 46, where the generated occupant distribution calculation means 20 calculates a distribution of the occupants to be generated with regard to the respective floors based on the predicted numbers of occupants to be generated.

After the distribution of the occupants to be generated is calculated at Step S46, the process proceeds to Step S47, where the assignment correction value calculation means 14 multiplies the time periods until the service is available calculated by the service available time period distribution calculation means 13 by the distribution of the occupants to be generated with regard to the respective floors calculated by the generated occupant distribution calculation means 20, and as a result of the multiplication, finds total wait times with regard to the respective floors. From them, the respective maximum total wait times are taken out, and are made to be assignment correction values. For example, assuming the calculated distribution of the occupants to be generated is as shown in FIG. 39, the total wait times with regard to the respective floors when the cage A is tentatively assigned are, based on the time periods until the service is available when the cage A is tentatively assigned as shown in FIG. 11 and the distribution of the occupants to be generated as shown in FIG. 39, as shown in FIG. 40.

From the result, the assignment correction value of the cage A is 4800. Similarly, the total wait times with regard to the respective floors of the cage B are as shown in FIG. 41, and the assignment estimation value of the cage B is 400. The total wait times with regard to the respective floors of the cage C are as shown in FIG. 42, and the assignment estimation value of the cage C is 3600.

After the assignment correction values are calculated at Step S47, the process proceeds to Step S48, where the assignment estimation values with regard to the respective cages are calculated by the assignment estimation value calculation means 11. After the assignment estimation values are calculated, the process proceeds to Step S49, where the cage assignment means 15 selects a cage with the optimal assignment estimation based on the assignment estimation values calculated by the assignment estimation value calculation means 11 and on the assignment correction values calculated by the assignment correction value calculation means 14, and assignment is outputted. For example, in the case where the calculated assignment estimation values of the cages A, B, and C are 500, 1000, and 300, respectively, the results of adding the corresponding assignment correction values of the cages A, B, and C to the respective assignment estimation values are 5300, 1400, and 9300, respectively, and thus, the cage B is selected as the most appropriate cage and is assigned.

Therefore, according to Embodiment 4, service according to the ratio of the predicted numbers of occupants to be generated is made possible, and shortening of the average wait time can be attempted.

Embodiment 5

Figure 43:
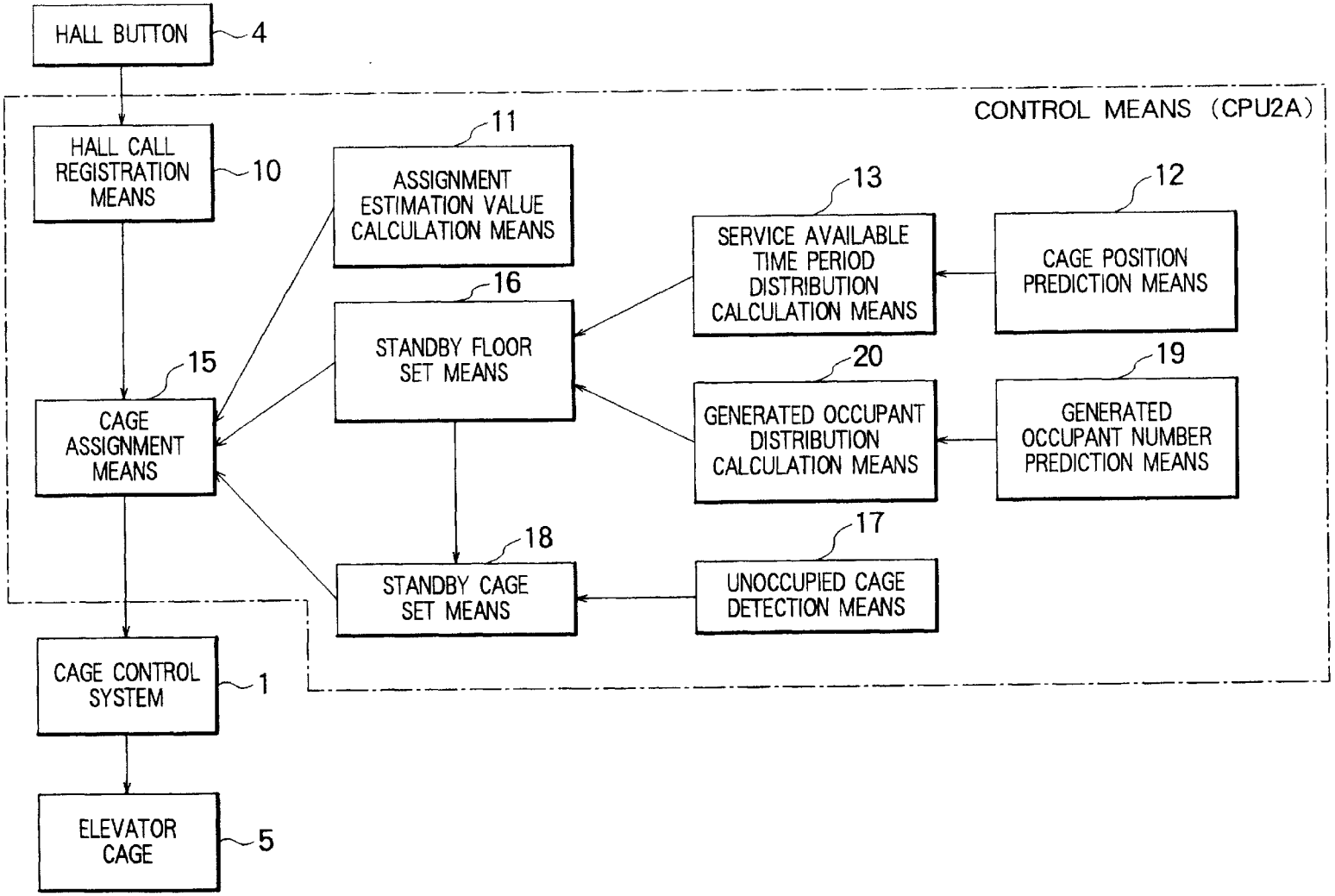
FIG. 43 explains a group-supervising control system for an elevator according to Embodiment 5 of the present invention and is a block diagram illustrating as blocks controlling functions of the CPU 2A as the control means of the group-supervising control system 2 illustrated in FIG. 1.

Next, FIG. 43 explains a group-supervising control system for an elevator according to Embodiment 5 of the present invention and is a block diagram illustrating as blocks controlling functions of the CPU 2A as the control means of the group-supervising control system 2 illustrated in FIG. 1.

In FIG. 43, the numerals identical to those of Embodiment 2 in FIG. 14 and those of Embodiment 4 in FIG. 37 designate identical parts and the description thereof is omitted. The standby floor set means 16 in Embodiment 5 sets, bas,ed on the distributions of the time periods until the service is available calculated by the service available time period distribution calculation means 13 and the distribution of the occupants to be generated calculated by the generated occupant distribution calculation means 20, a standby floor where an unoccupied cage is made to stand by, and the standby cage set means 18 sets a standby cage based on the output from the unoccupied cage detection means 17 and from the standby floor set means 16. The cage control system 1 of the cage which receives from the cage assignment means 15 a standby output for making the cage set by the standby cage set means 18 stand by on the standby floor set by the standby floor set means 16 responds by controlling an elevator cage 5 including the corresponding drive control device 3.

Figure 44:
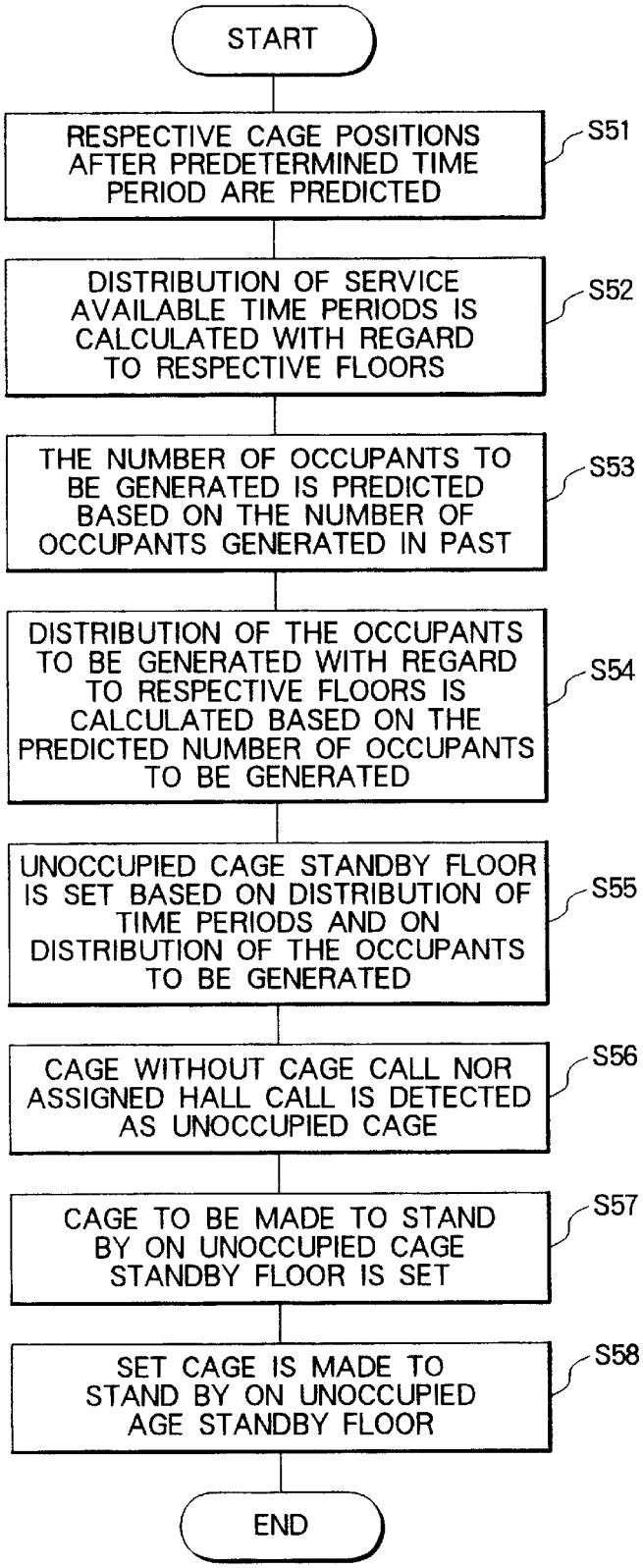
FIG. 44 explains operation of Embodiment 5 of the present invention and is a flow chart illustrating the controlling functions of the CPU 2A as the control means of the group-supervising control system 2 illustrated in FIG. 1.

Next, operation according to Embodiment 5 constructed as above is now described according to a flow chart shown as FIG. 44 as the content of the controlling functions by the CPU 2A with reference to FIGS. 16 and 17 illustrating relationships between calls and cage positions, FIGS. 18 to 20 which are explanatory views of time periods until cages can respond to the respective floors, FIG. 21 which is an explanatory view of time periods until the service is available with regard to the respective floors, FIG. 45 illustrating a relationship between calls and cage positions, FIG. 46 which is an explanatory view of time periods until the service is available with regard to the respective floors, FIG. 47 illustrating a relationship between calls and cage positions, FIG. 48 which is an explanatory view of time periods until the service is available with regard to the respective floors, and FIGS. 49 to 51 which are explanatory views of total wait times with regard to the respective floors.

The operation to set a standby cage and a standby floor and to make the standby cage to stand by on the standby floor is described taking as an example a case where, as shown in FIG. 16, there are cages A, B, and C as the elevator cages 5 to be group-supervised, with the cage A standing by with its door closed on the first floor, with the cage B travelling up having a cage call on the ninth floor as shown by a circle, and with the cage C standing by with its door closed on the ninth floor.

In the flow chart shown in FIG. 44, first, at Step S51, the cage position prediction means 12 predicts, based on the present cage positions of the respective cages, cage positions after a predetermined time period elapses. For example, in the case where the predetermined time period is 10 seconds, the cage positions after 10 seconds from those shown in FIG. 16 are shown in FIG. 17.

After the cage positions are predicted, the process proceeds to Step S52, where the service available time period distribution calculation means 13 calculates the time periods until the service is available with regard to the respective floors. The time periods until a cage can respond are calculated assuming by way of example that a cage expends 2 seconds in advancing a distance of one floor and 10 seconds on one stop, and that the cage is sequentially driven up and down throughout all the floors, and that, regarding a cage of no direction, the cage travels from the floor where the cage is positioned directly to the respective floors.

In the case where the time periods until the respective cages can respond when the cages are positioned as shown in FIG. 17 are calculated with regard to this case, the time periods until the cages A, B, and C can respond to the respective floors are shown in FIGS. 18, 19, and 20, respectively.

The distribution of the time periods until the service is available (arrival times of a cage capable of responding earliest) with regard to the respective floors calculated from the above results is shown in FIG. 21.

After the distribution of the time periods until the service is available is calculated at Step S52, the process proceeds to Step S53, where the generated occupant number prediction means 19 predicts the number of occupants to be generated in the future based on the number of occupants generated in the past with regard to the respective floors.

After the number of occupants to be generated is predicted at Step S53, the process proceeds to Step S54, where the generated occupant distribution calculation means 20 calculates a distribution of the occupants to be generated with regard to the respective floors based on the number of occupants to be generated predicted by the generated occupant number prediction means 19.

After the distribution of the occupants to be generated is calculated at Step S54, the process proceeds to Step S55, where the standby floor set means 16 multiplies the time periods until the service is available calculated by the service available time period distribution calculation means 13 by the distribution of the occupants to be generated calculated by the generated occupant distribution calculation means 20, and as a result of the multiplication, finds total wait times with regard to the respective floors. The floor from which the maximum total wait time is taken out is made to be the unoccupied cage standby floor. For example, assuming the calculated distribution of the occupants to be generated is as shown in FIG. 39, the total wait times with regard to the respective floors are as shown in FIG. 49. Therefore, the unoccupied cage standby floor in this case is the fourth floor.

After the unoccupied cage standby floor is set at Step S55, the process proceeds to Step S56, where the unoccupied cage detection means 17 detects as an unoccupied cage a cage which has responded to the whole calls and has neither a cage call nor an assigned hall call. In this case, the cages A and C are detected as unoccupied cages.

After the unoccupied cages are detected at Step S56, the process proceeds to Step S57, where the standby cage set means 18 sets a cage to stand by on the unoccupied cage standby floor among the unoccupied cages. The setting is conducted by multiplying distributions of the time periods until the service is available with regard to the respective floors by the distribution of the occupants to be generated in the case where the respective unoccupied cages are tentatively made to stand by on the unoccupied cage standby floor and by calculating the total wait times with regard to the respective floors, and the cage with which the maximum total wait time is smaller than that in a case where the same cage is not made to stand by and is smaller than that in a case where any other cage is made to stand by is set as the standby cage. For example, in the case where the unoccupied cage A is made to stand by on the unoccupied cage standby floor, the cage positions are shown in FIG. 45, the distribution of the time periods until the service is available is shown in FIG. 46, and the total wait times are shown in FIG. 50. In the case where the unoccupied cage C is made to stand by on the unoccupied cage standby floor, the cage positions are shown in FIG. 46, the distribution of the time periods until the service is available is shown in FIG. 48, and the total wait times are shown in FIG. 51.

Since the maximum total wait time in the case where the cage A is made to stand by is 1800 while that in the case where the cage C is made to stand by is 400, the cage C is set as the standby cage. After the standby cage is set, the process proceeds to Step S58, where the cage assignment means 15 makes the set unoccupied cage C stand by on the unoccupied cage standby floor (the fourth floor).

Therefore, according to Embodiment 5, service according to the ratio of the predicted numbers of occupants to be generated is made possible, and shortening of the average wait time can be attempted.

Embodiment 6

Figure 52:
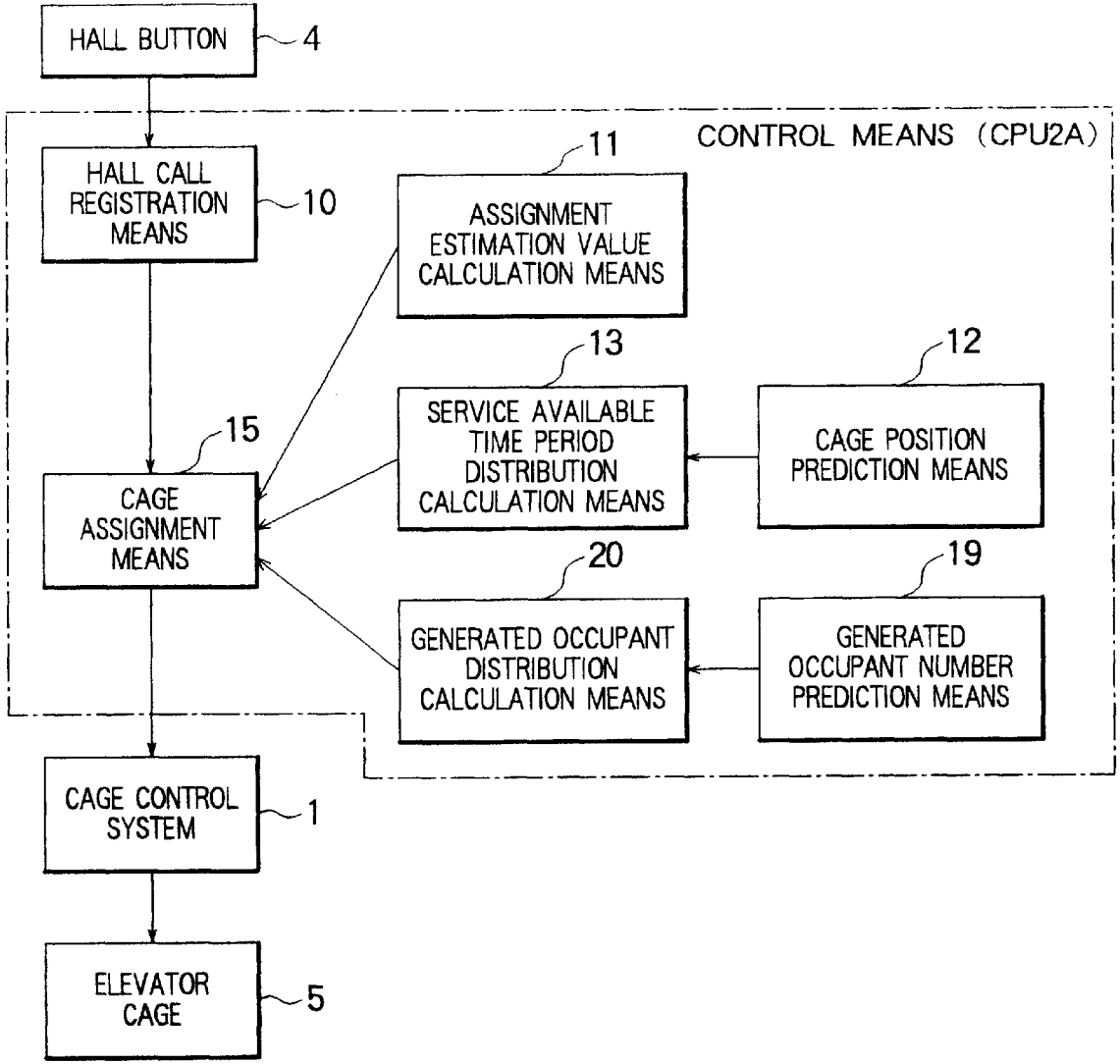
FIG. 52 explains a group-supervising control system for an elevator according to Embodiment 6 of the present invention and is a block diagram illustrating as blocks controlling functions of the CPU 2A as the control means of the group-supervising control system 2 illustrated in FIG. 1.

Next, FIG. 52 explains a group-supervising control system for an elevator according to Embodiment 6 of thle present invention and is a block diagram illustrating as blocks controlling functions of the CPU 2A as the control means of the group-supervising control system 2 illustrated in FIG. 1.

In FIG. 52, the numerals identical to those of Embodiment 3 in FIG. 26 and those of Embodiment 4 in FIG. 37 designate identical parts and the description thereof is omitted. The cage assignment means 15 in Embodiment 6 sets a deadhead cage and a deadhead floor, based on the distributions of the time periods until the service is available calculated by the service available time period distribution calculation means 13 and the distribution of the occupants to be generated calculated by the generated occupant distribution calculation means 20. The cage control system 1 of the cage which receives a deadhead output from the cage assignment means 15 responds and controls an elevator cage 5 including the corresponding drive control device 3.

Figure 53:
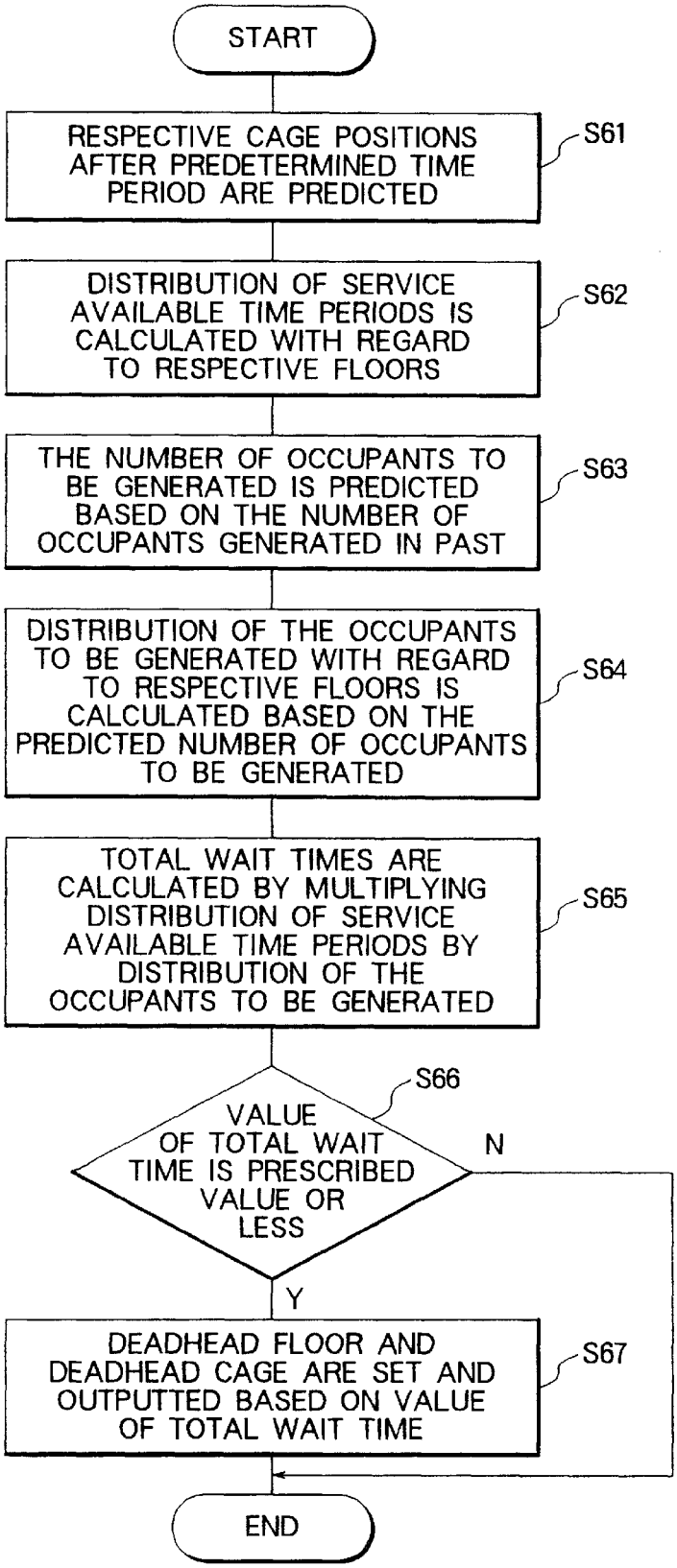
FIG. 53 explains operation of Embodiment 6 of the present invention and is a flow chart illustrating the controlling functions of the CPU 2A as the control means of the group-supervising control system 2 illustrated in FIG. 1.

Next, operation according to Embodiment 6 constructed as above is now described according to a flow chart shown as FIG. 53 as the content of the controlling functions by the CPU 2A with reference to FIGS. 28 and 29 illustrating relationships between calls and cage positions, FIGS. 30 and 31 which are explanatory views of time periods until cages can respond to the respective floors, FIG. 32 which is an explanatory view of time periods until the service is available with regard to the respective floors, FIG. 33 illustrating a relationship between calls and cage positions, FIG. 34 which is an explanatory view of time periods until the service is available with regard to the respective floors, FIG. 35 illustrating a relationship between calls and cage positions, FIG. 36 which is an explanatory view of time periods until the service is available with regard to the respective floors, and FIGS. 54 to 56 which are explanatory views of total wait times with regard to the respective floors.

The operation to set a deadhead cage and a deadhead floor and to forcedly make the deadhead cage stop at the deadhead floor is described taking as an example a case where, as shown in FIG. 28, there are cages A and B as the elevator cages 5 to be group-supervised, the cage A travelling upward having a cage call on the tenth floor as shown by a circle, and the cage B travelling upward having a cage call on the ninth floor as shown by another circle.

In the flow chart shown in FIG. 53, first, at Step S61, the cage position prediction means 12 predicts cage positions after a predetermined time period elapses, based on the present cage positions of the respective cages. For example, in the case where the predetermined time period is 10 seconds, the cage positions as 10 seconds elapse from those shown in FIG. 28 are shown in FIG. 29.

After the cage positions are predicted at Step S61, the process proceeds to Step S62, where the service available time period distribution calculation means 13 calculates the time periods until the service is available with regard to the respective floors. The time periods until a cage can respond are calculated assuming by way of example that a cage expends 2 seconds in advancing a distance of one floor and 10 seconds on one stop, and that the cage is sequentially driven up and down throughout all the floors, and that, regarding a cage of no direction, the cage directly travels to the respective floors from the floor where the cage is positioned.

In the case where the time periods until the respective cages can respond when the cages are positioned as shown in FIG. 29 are calculated with regard to this case, the time periods until the cages A and B can respond to the respective floors are shown in FIGS. 30 and 31, respectively.

The distribution of the time periods until the service is available (arrival times of a cage capable of responding earliest) with regard to the respective floors calculated from the above results is shown in FIG. 32.

After the distribution of the time periods until the service is available is calculated at Step S62, the process proceeds to Step S63, where the generated occupant number prediction means 19 predicts the number of occupants to be generated in the future based on the number of occupants generated in the past with regard to the respective floors.

After the number of occupants to be generated is predicted at Step S63, the process proceeds to Step S64, where the generated occupant distribution calculation means 20 calculates a distribution of the occupants to be generated with regard to the respective floors based on the number of occupants to be generated predicted by the generated occupant number prediction means 19.

After the distribution of the occupants to be generated is calculated at Step S64, the process proceeds to Step S65, where the cage assignment means 15 calculates total wait times by multiplying the time periods until the service is available calculated by the service available time period distribution calculation means 13 by the distribution of the occupants to be generated calculated by the generated occupant distribution calculation means 20. For example, assuming the calculated distribution of the occupants to be generated is as shown in FIG. 39, the total wait times are as shown in FIG. 54.

After the total wait times are calculated al: Step S65, the process proceeds to Step S66, where the cage assignment means 15 checks whether the maximum total wait time exceeds a prescribed value or not. In the case where the maximum total wait time does not exceed the prescribed value, the process ends. In the case where the maximum total wait time exceeds the prescribed value, the process proceeds to Step S67, where a deadhead floor and a deadhead cage are set, and the deadhead cage is forcedly made to stop at the deadhead floor.

For example, assuming the calculated distribution of the occupants to be generated is as shown in FIG. 39, the deadhead floor is the floor where the cage exists at present, and the deadhead cage is the cage with which, when the cage is made to deadhead to the floor, the maximum of the time periods until the service is available multiplied by the distribution of the occupants to be generated is smaller than that with the other cage, the deadhead floor is the first floor in the case where the cage A is forcedly made to deadhead. The cage positions in that case are shown in FIG. 33, and the distribution of the time periods until the service is available is shown in FIG. 34, and the total wait times are shown in FIG. 55.

Similarly, in the case where the unoccupied cage B is forcedly made to deadhead, the deadhead floor is the second floor. The cage positions in that case are shown in FIG. 35, the distribution of the time periods until the service is available is shown in FIG. 36, and the total wait times are shown in FIG. 56.

Since the maximum total wait time in the case where the cage A is forcedly made to deadhead is 3600 while the one in the case where the cage B is forcedly made to deadhead is 10800, the cage A is set as the deadhead cage, and the deadhead cage (A) is forcedly made to stop at the deadhead floor (the first floor).

Therefore, according to Embodiment 6, service according to the ratio of the predicted number of occupants to be generated is made possible, and shortening of the average wait time can be attempted.

Embodiment 7

Figure 57:
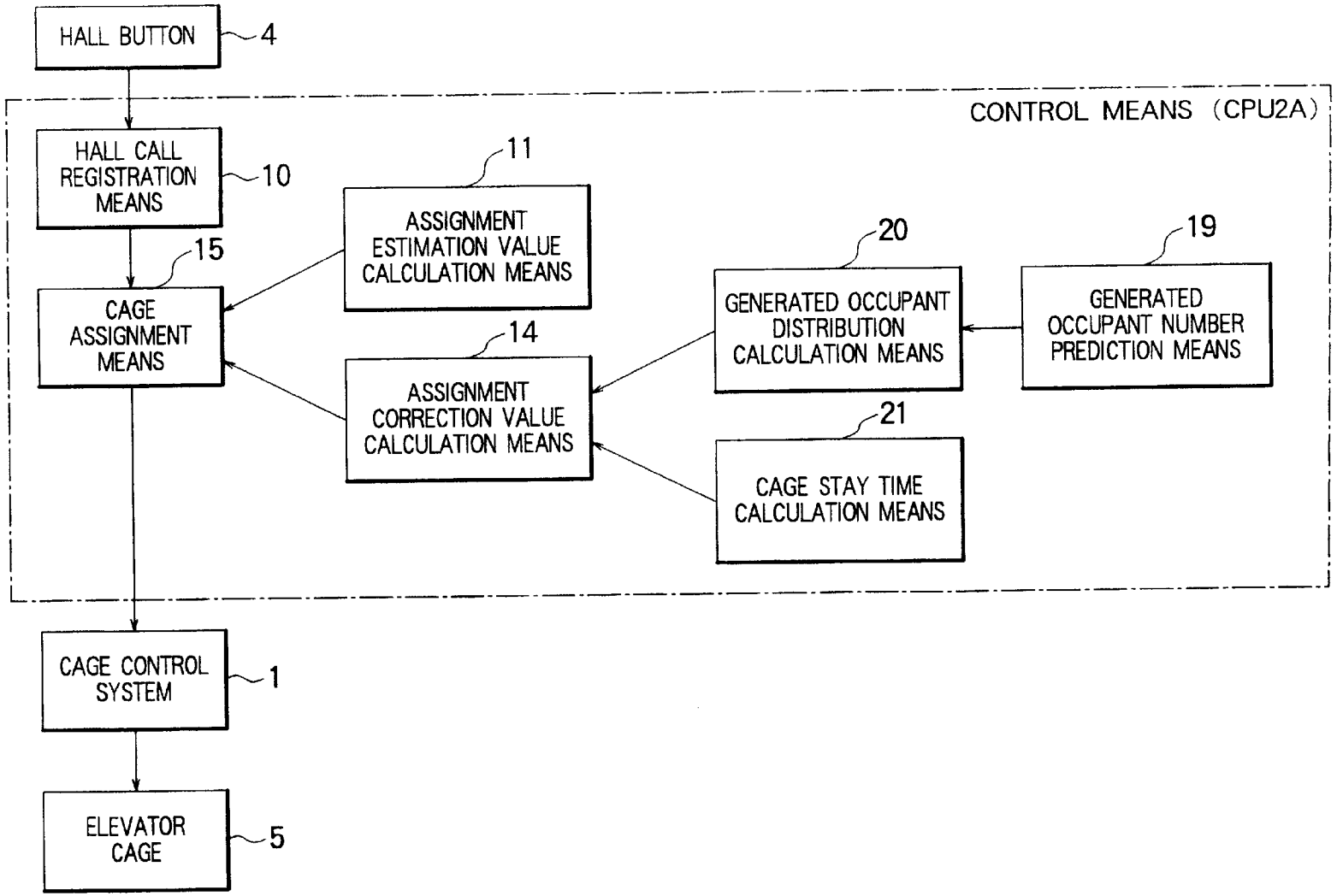
FIG. 57 explains a group-supervising control system for an elevator according to Embodiment 7 of the present invention and is a block diagram illustrating as blocks controlling functions of the CPU 2A as the control means of the group-supervising control system 2 illustrated in FIG. 1.

Next, FIG. 57 explains a group-supervising control system for an elevator according to Embodiment 7 of the present invention and is a block diagram illustrating as blocks controlling functions of the CPU 2A as the control means of the group-supervising control system 2 illustrated in FIG. 1.

In FIG. 57, the numerals identical to those of Embodiment 4 in FIG. 37 designate identical parts and the description thereof is omitted. As a new numeral, a numeral 21 denotes a cage stay time calculation means for calculating cage stay times of the respective cages with regard to the respective floors. The assignment correction value calculation means 14 in Embodiment 7 calculates assignment correction values for correcting the assignment estimation values based on the distribution of the occupants to be generated calculated by the generated occupant distribution calculation means 20 and the cage stay times with regard to the respective floors calculated by the cage stay time calculation means 21. The cage assignment means 15 selects and assigns a cage whose assignment estimation value is the minimum as the most appropriate cage based on the hall calls registered by the hall call registration means 10, the assignment estimation values calculated by the assignment estimation value calculation means 11, and the assignment correction values calculated by the assignment correction value calculation means 14. The cage control system 1 of the cage which receives an assignment output from the cage assignment means 15 responds to it and controls an elevator cage 5 including the corresponding drive control device 3.

Figure 58:
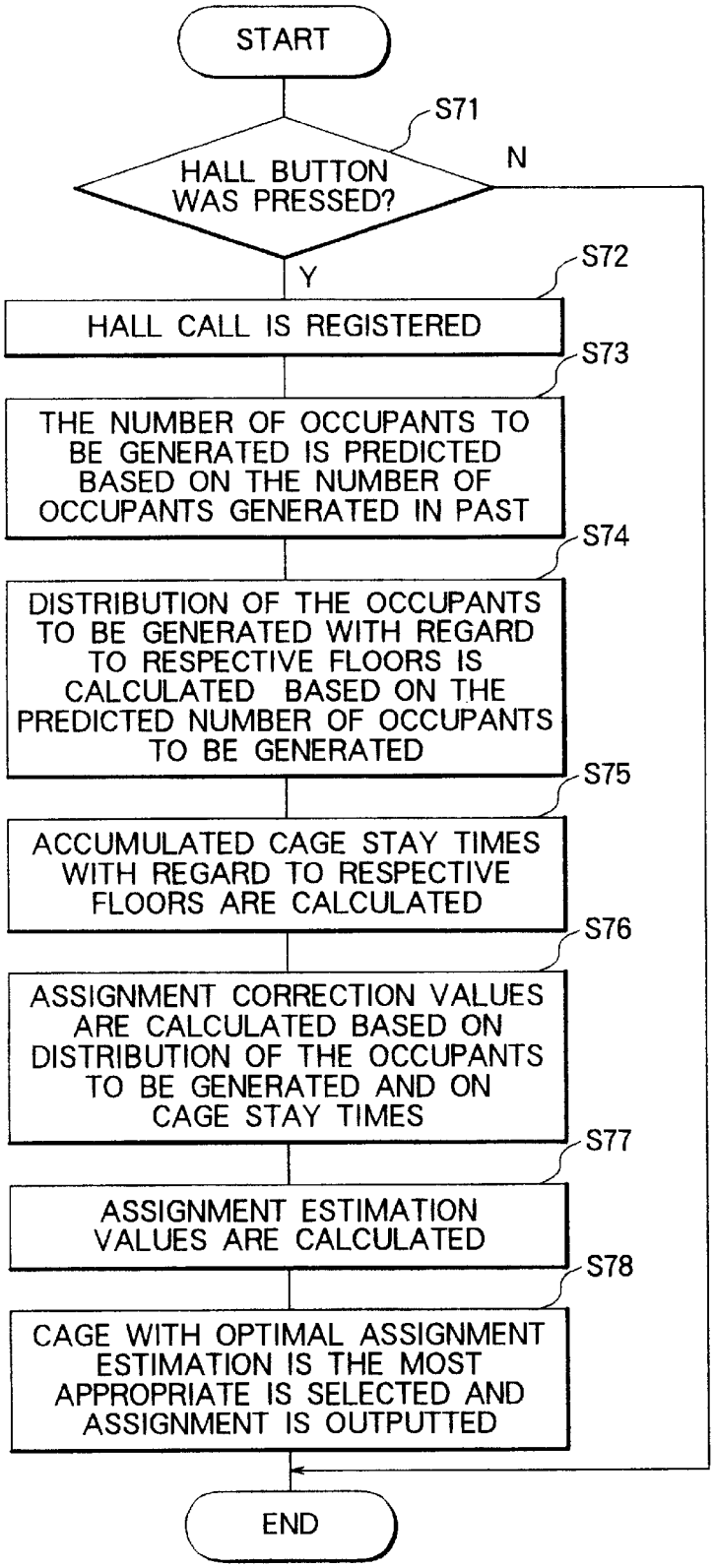
FIG. 58 explains operation of Embodiment 7 of the present invention and is a flow chart illustrating the controlling functions of the CPU 2A as the control means of the group-supervising control system 2 illustrated in FIG. 1.

Next, operation according to Embodiment 7 constructed as above is now described according to a flow chart shown as FIG. 58 as the content of the controlling functions by the CPU 2A with reference to FIGS. 4 to 7 illustrating relationships between calls and cage positions, FIG. 39 which is an explanatory view of the number of occupants to be generated with regard to the respective floors, FIG. 59 which is an explanatory view of cage stay times with regard to the respective floors, and FIG. 60 which is an explanatory view of cage stay ratios with regard to the respective floors.

The assignment operation is described taking as an example the case where, as shown in FIG. 4, there are cages A, B, and C as the elevator cages 5 to be group-supervised, the cage A standing by with its door closed on the first floor, the cage B travelling upward having an UP assignment on the fifth floor as shown by an arrow, and the cage C travelling upward having a cage call on the ninth floor as shown by a circle, and a hall call in the UP direction is registered on the fourth floor as shown by a triangle.

In the flow chart shown in FIG. 58, first, at Step S71, whether the hall button 4 was pressed or not is checked. In the case where the hall button 4 was not pressed, nothing is conducted and the process ends. In the case where the hall button 4 was pressed, the process proceeds to Step S72, where a hall call is registered by the hall call registration means 10.

After the hall call is registered at Step S72, the process proceeds to Step S73, where the generated occupant number prediction means 19 predicts the number of occupants to be generated in the future based on the number of occupants generated in the past with regard to the respective floors.

After the number of occupants to be generated is predicted at Step S73, the process proceeds to Step S74, where the generated occupant distribution calculation means 20 calculates a distribution of the occupants to be generated with regard to the respective floors based on the number of occupants to be generated predicted by the generated occupant number prediction means 19.

After the distribution of the occupants to be generated is calculated at Step S74, the process proceeds to Step S75, where the cage stay time calculation means 21 calculates accumulated cage stay times with regard to the respective floors from the past to the present time (for example, 8:00 a.m.–10:00 a.m.).

After the cage stay times are calculated at Step S75, the process proceeds to Step S76, where the assignment correction value calculation means 14 first predicts cage positions after a predetermined time period elapses in the case where the hall call in the UP direction on the fourth floor is tentatively assigned to the cages A–C, respectively. For example, the cage positions of the cages A–C after the predetermined time period in the case where the hall call in the UP direction on the fourth floor is tentatively assigned to the cage A are shown in FIG. 5. Similarly, the cage positions after the predetermined time period in the case where the call is tentatively assigned to the cage B are shown in FIG. 6, and the cage positions after the predetermined time period in the case where the call is tentatively assigned to the cage C are shown in FIG. 7. Further, by subtracting the cage stay times from the distribution of the occupants to be generated at that time, the cage stay ratios (the number of occupants to be generated per cage stay time) with regard to the respective floors are calculated. From these cage stay ratios, the respective maximum ratios stay are taken out except those of the floors where the cages, and are made to be assignment correction values of the respective cages. For example, by letting the calculated distribution of the occupants to be generated as shown in FIG. 39 and the distribution of cage stay times as shown in FIG. 59, the cage stay ratios with regard to the respective floors is such as shown in FIG. 60.

Therefore, the assignment correction value of the cage A is 3, which is the maximum ratio except those of the floors where the cages stay (the fourth floor–UP, the fifth floor–UP, and the ninth floor–UP and DN). Similarly, the assignment correction value of the cage B is 6, and the assignment correction value of the cage C is 7.

After the assignment correction values are calculated at Step S76, the process proceeds to Step S77, where the assignment estimation values with regard to the respective cages are calculated by the assignment estimation value calculation means 11.

After the assignment estimation values are calculated at Step S77, the process proceeds to Step S78, where the cage assignment means 15 selects a cage with the optimal assignment estimation based on the assignment estimation values and on the assignment correction values, and assignment is outputted. For example, the calculated assignment estimation values of the cages A, B, and C are 5, 9, and 11, respectively, and thus, the cage A is selected as the most appropriate cage and is assigned.

Therefore, according to Embodiment 7, service according to the ratio of the number of occupants to be generated and the cage stay times is made possible, and improvement in the service can be attempted.

Embodiment 8

Figure 61:
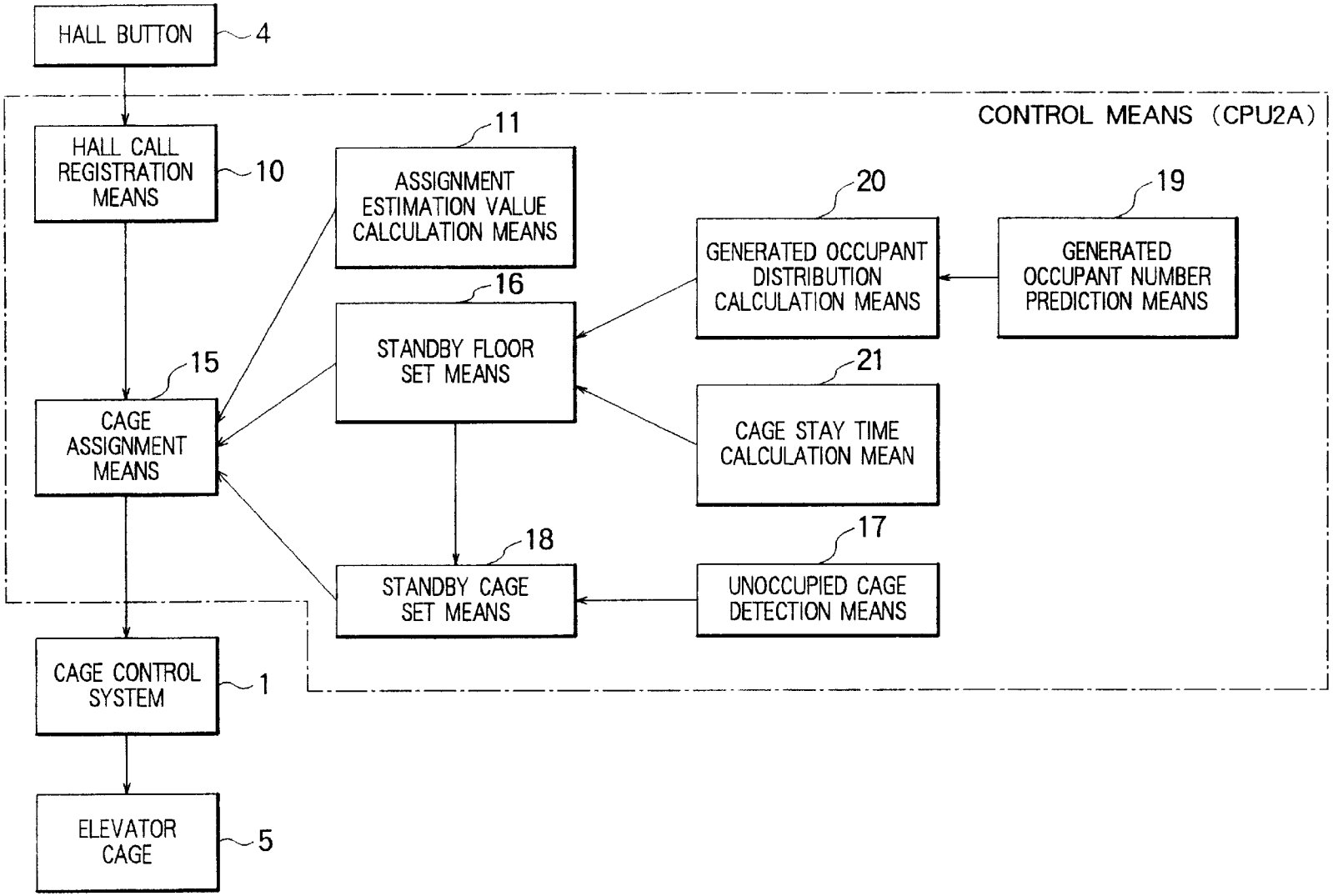
FIG. 61 explains a group-supervising control system for an elevator according to Embodiment 8 of the present invention and is a block diagram illustrating as blocks controlling functions of the CPU 2A as the control means of the group-supervising control system 2 illustrated in FIG. 1.

Next, FIG. 61 explains a group-supervising control system for an elevator according to Embodiment 8 of the present invention and is a block diagram illustrating as blocks controlling functions of the CPU 2A as the control means of the group-supervising control system 2 illustrated in FIG. 1.

In FIG. 61, the numerals identical to those of Embodiment 5 in FIG. 43 and those of Embodiment 7 in FIG. 57 designate identical parts and the description thereof is omitted. The standby floor set means 16 in Embodiment 8 sets a standby floor where an unoccupied cage is made to stand by based on the distribution of the occupants to be generated calculated by the generated occupant distribution calculation means 20 and the cage stay times with regard to the respective floors calculated by the cage stay time calculation means 21, and the standby cage set means 18 sets a standby cage based on the output from the unoccupied cage detection means 17 and from the standby floor set means 16. The cage control system 1 of the cage which receives from the cage assignment means 15 a standby output for making the standby cage set by the standby cage set means 18 stand by on the standby floor set by the standby floor set means 16 responds to it and controls an elevator cage 5 including the corresponding drive control device 3.

Figure 62:
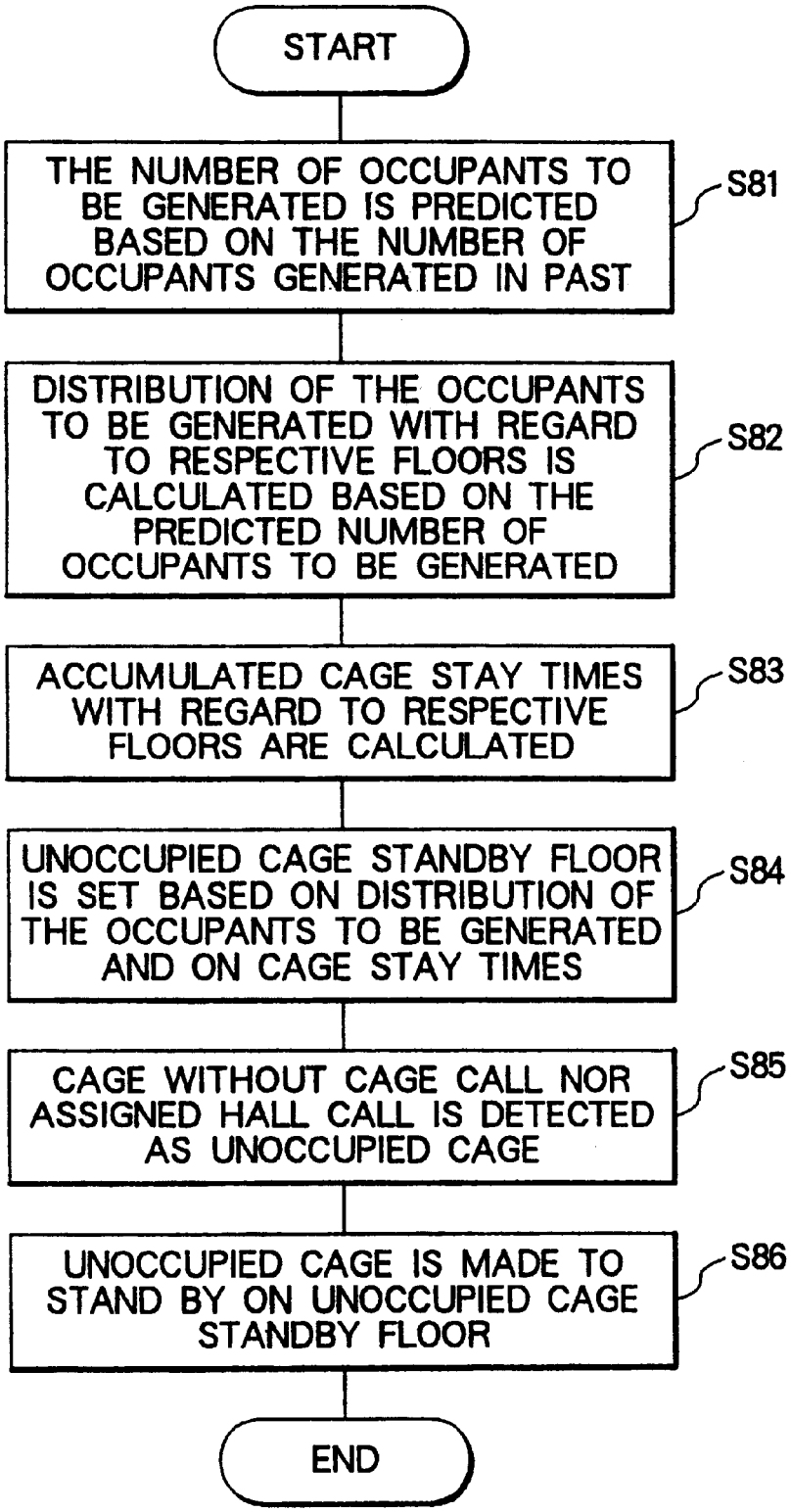
FIG. 62 explains operation of Embodiment 8 of the present invention and is a flow chart illustrating the controlling functions of the CPU 2A as the control means of the group-supervising control system 2 illustrated in FIG. 1.

Next, operation according to Embodiment 8 constructed as above is now described according to a flow chart shown as FIG. 62 as the content of the controlling functions by the CPU 2A with reference to FIG. 16 illustrating a relationship between calls and cage positions, FIG. 39 which is an explanatory view of the number of occupants to be generated with regard to the respective floors, FIG. 59 which is an explanatory view of cage stay times with regard to the respective floors, and FIG. 60 which is an explanatory view of cage stay ratios with regard to the respective floors.

The operation to set a standby cage and a standby floor and to make the standby cage stand by on the standby floor is described taking as an example the case where, as shown in FIG. 16, there are cages A, B, and C as the elevator cages 5 to be group-supervised, the cage A standing by with its door closed on the first floor, the cage B travelling upward having a cage call on the ninth floor as shown by a circle, and the cage C standing by with its door closed on the ninth floor.

In the flow chart shown in FIG. 62, first, at. Step S81, the generated occupant number prediction means 19 predicts the number of occupants to be generated in the future based on the number of occupants generated in the past with regard to the respective floors.

After the number of occupants to be generated is predicted at Step S81, the process proceeds to Step S82, where the generated occupant distribution calculation means 20 calculates a distribution of the occupants to be generated with regard to the respective floors based on the number of occupants to be generated predicted by the generated occupant number prediction means 19.

After the distribution of the occupants to be generated is calculated at Step S82, the process proceeds to Step S83, where the cage stay time calculation means 21 calculates accumulated cage stay times with regard to the respective floors.

After the cage stay times are calculated at Step S83, the process proceeds to Step S84, where the standby floor set means 16 subtracts the cage stay times calculated by the cage stay time calculation means 21 from the distribution of the occupants to be generated calculated by the generated occupant distribution calculation means 20, and calculates the cage stay ratios with regard to the respective floors. Floors are made to be unoccupied cage standby floors in order from the one from which the maximum cage stay ratio is taken out. For example, assuming the distribution of the occupants to be generated is as shown in FIG. 39 and the distribution of cage stay times is as shown in FIG. 59, the cage stay ratios with regard to the respective floors is as shown in FIG. 60. In this case, the floor of the maximum cage stay ratio is the fourth floor, which is followed by the fifth floor and then the first floor, and they are set as the standby floors in this order.

After the unoccupied cage standby floors are set at Step S84, the process proceeds to Step S85, where the unoccupied cage detection means 17 detects as an unoccupied cage a cage which has responded to the whole calls and has neither a cage call nor an assigned hall call. In the case shown in FIG. 16, for example, the cages A and C are detected as unoccupied cages.

After the unoccupied cages are detected at Step S85, the process proceeds to Step S86, where the standby cage set means 18 sets a cage to stand by on the unoccupied cage standby floor among the unoccupied cages, and then, the cage assignment means 15 makes the unoccupied cage stand by on the unoccupied cage standby floor. In this case, since the two cages A and C were detected as the unoccupied cages, the unoccupied cages A and C are made to stand by on the fourth and fifth floors, from which the maximum and the next maximum cage stay ratios are taken out, respectively.

Therefore, according to Embodiment 8, service according to the ratio of the number of occupants to be generated and the cage stay times is made possible, and improvement in the service can be attempted.

Embodiment 9

Figure 63:
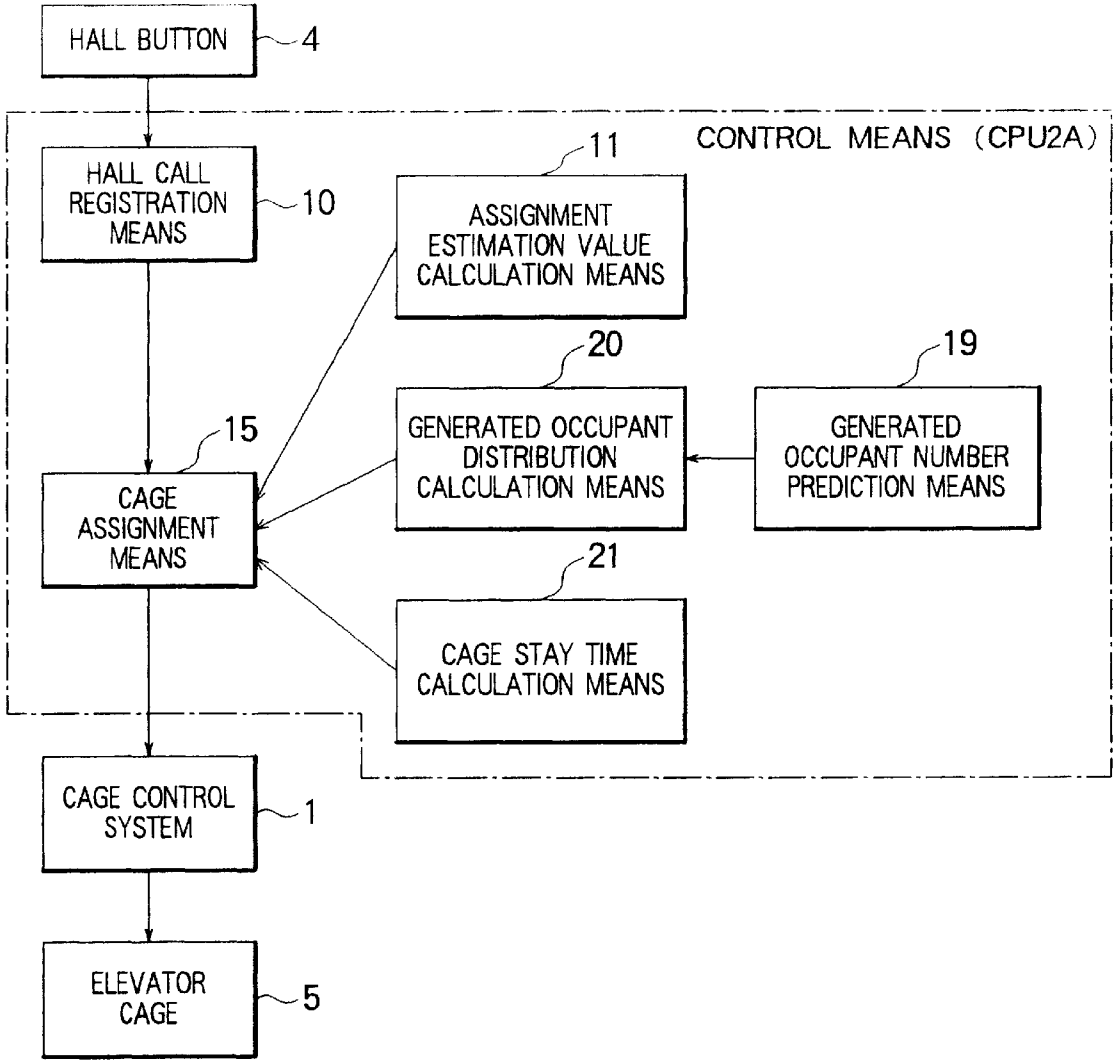
FIG. 63 explains a group-supervising control system for an elevator according to Embodiment 9 of the present invention and is a block diagram illustrating as blocks controlling functions of the CPU 2A as the control means of the group-supervising control system 2 illustrated in FIG. 1.

Next, FIG. 63 explains a group-supervising control system for an elevator according to Embodiment 9 of the present invention and is a block diagram illustrating as blocks controlling functions of the CPU 2A as the control means of the group-supervising control system 2 illustrated in FIG. 1.

In FIG. 63, the numerals identical to those of Embodiment 6 in FIG. 52 and those of Embodiment 7 in FIG. 57 designate identical parts and the description thereof is omitted. The cage assignment means 15 in Embodiment 9 sets a deadhead cage and a deadhead floor, based on the distribution of the occupants to be generated calculated by the generated occupant distribution calculation means 20 and the cage stay times with regard to the respective floors calculated by the cage stay time calculation means 21. The cage control system 1 of the cage which receives a deadhead output from the cage assignment means 15 responds to it and controls an elevator cage 5 including the corresponding drive control device 3.

Figure 64:
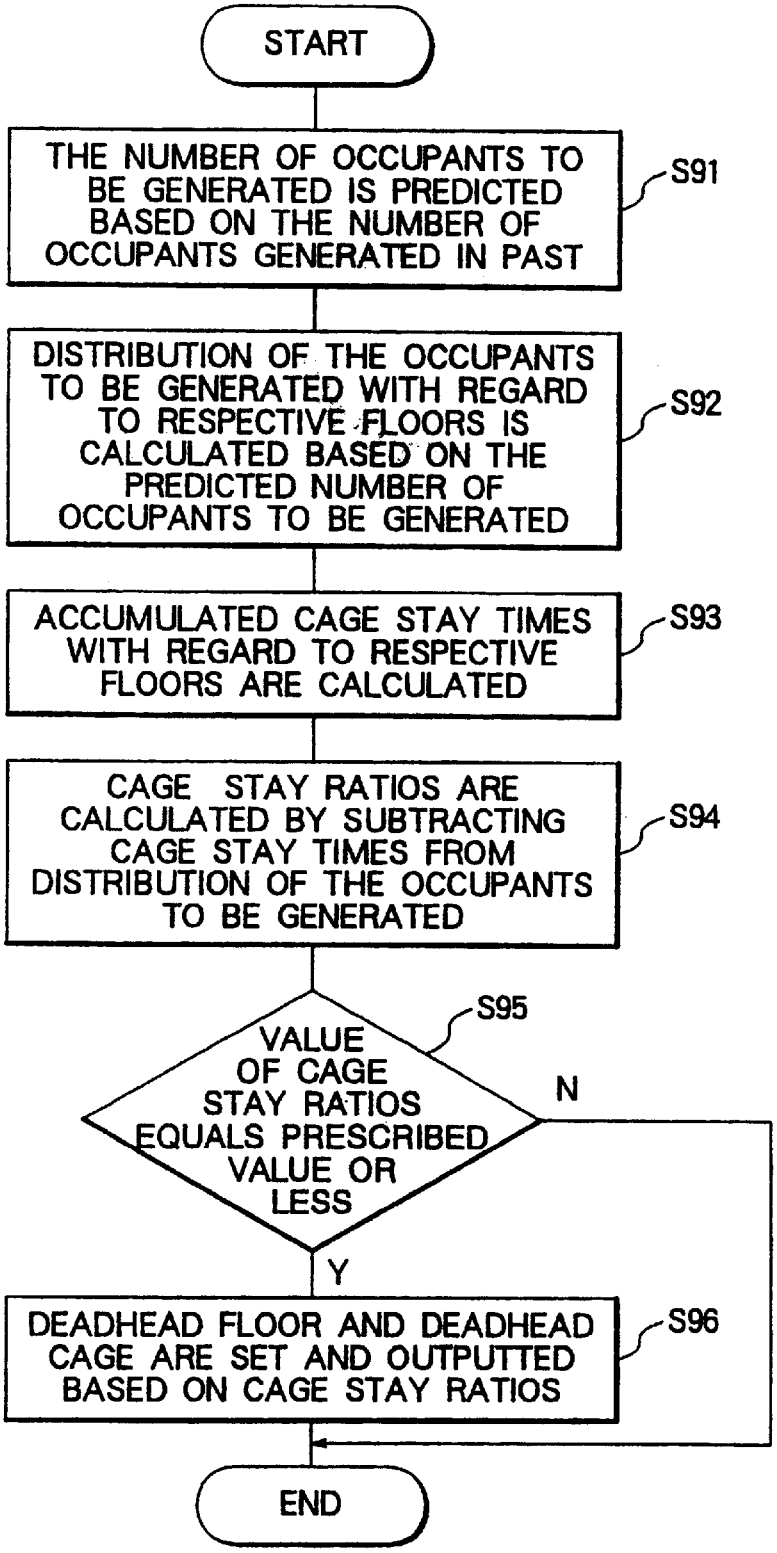
FIG. 64 explains operation of Embodiment 9 of the present invention and is a flow chart illustrating the controlling functions of the CPU 2A as the control means of the group-supervising control system 2 illustrated in FIG. 1.

Next, operation according to Embodiment 9 constructed as above is now described according to a flow chart shown as FIG. 64 as the content of the controlling functions by the CPU 2A with reference to FIG. 28 illustrating a relationship between calls and cage positions, FIG. 39 which is an explanatory view of the number of occupants to be generated with regard to the respective floors, FIG. 59 which is an explanatory view of cage stay times with regard to the respective floors, and FIG. 60 which is an explanatory view of cage stay ratios with regard to the respective floors.

The operation to set a deadhead cage and a deadhead floor and to forcedly make the deadhead cage stop at the deadhead floor is described taking as an example a case where, as shown in FIG. 28, there are cages A and B as the elevator cages 5 to be group-supervised, the cage A travelling upward having a cage call on the tenth floor as shown by a circle, and the cage B travelling upward having a cage call on the ninth floor as shown by another circle.

In the flow chart shown in FIG. 64, first, at Step S91, the generated occupant number prediction means 19 predicts the number of occupants to be generated in the future based on the number of occupants generated in the past with regard to the respective floors.

After the number of occupants to be generated is predicted at Step S91, the process proceeds to Step S92, where the generated occupant distribution calculation means 20 calculates a distribution of the number of occupants to be generated with regard to the respective floors based on the predicted numbers of occupants to be generated.

After the distribution of the number of occupants to be generated is calculated at Step S92, the process proceeds to Step S93, where the cage stay time calculation means 21 calculates accumulated cage stay times with regard to the respective floors.

After the cage stay times are calculated at Step S93, the process proceeds to Step S94, where the cage assignment means 15 subtracts the cage stay times from the distribution of the occupants to be generated, and calculates the cage stay ratios with regard to the respective floors. For example, assuming the distribution of the occupants to be generated is as shown in FIG. 39 and the distribution of cage stay times is as shown in FIG. 59, the cage stay ratios with regard to the respective floors is as shown in FIG. 60.

After the cage stay ratios are calculated at Step S94, the process proceeds to Step S95, where the cage assignment means 15 checks whether the cage stay ratios exceed a prescribed value or not. In the case where the cage stay ratios do not exceed the prescribed value, the process ends. In the case where the cage stay ratios exceed the prescribed value, the process proceeds to Step S96, where a deadhead floor and a deadhead cage are set based on the cage stay ratios, and the deadhead cage is forcedly made to stop at the deadhead floor. For example, assuming the deadhead floor is the floor of the maximum cage stay ratio and the deadhead cage is the cage which can respond earliest to the floor of the maximum cage stay ratio, the deadhead floor is the fourth floor and the deadhead cage is the cage B.

Accordingly, the deadhead cage B is forcedly made to stop at the deadhead floor (the fourth floor).

Therefore, according to Embodiment 9, service according to the ratio of the number of occupants to be generated and the cage stay times is made possible, and improvement in the service can be attempted.

Industrial Applicability

As described in the above, according to the present invention, by decreasing the difference between the time periods until the service is available with regard to the respective floors (the difference between the maximum predicted arrival time and the minimum predicted arrival time) and by making more even the time periods until the service is available with regard to the respective floors, the service unevenness can be decreased. Further, service according to the ratio of the predicted numbers of occupants to be generated is made possible, and shortening of the average wait time can be attempted. Still further, service according to the ratio of the number of occupants to be generated and the cage stay times is made possible. Therefore, a group-supervising control system for an elevator with which improvement in the service can be attempted can be provided.

What is claimed is:

1. A group-supervising control system for an elevator comprising:

hall call registration means for registering a hall call based on operation of a hall button provided at a hall on each floor;

assignment estimation value calculation means for calculating assignment estimation values for selecting and assigning a cage-to-serve among a plurality of cages;

cage assignment means for assigning a most appropriate cage among said plurality of cages based on said assignment estimation values to a hall call registered in said hall call registration means to transmit to a corresponding cage control system an assignment output for making said cage serve the hall where said hall call is generated;

control means comprising:

cage position prediction means for predicting, based on present cage positions, cage positions after a predetermined time period elapses;

service available time period distribution calculation means for, based on the cage positions predicted by said cage position prediction means, calculating distributions of time periods until service is available, that is, expected arrival times at the respective floors of a cage capable of responding to a hall call earliest; and assignment correction value calculation means for calculating assignment correction values for correcting said assignment estimation values, based on said distributions of the time periods until the service is available, said cage assignment means correcting said assignment estimation values based on said assignment correction values to select the most appropriate cage and to transmit an assignment output.

2. The group-supervising control system for an elevator as claimed in claim 1, wherein said control means further comprises:

generated occupant number prediction means for predicting number of occupants for the respective floors; and generated occupant distribution calculation means for calculating a distribution of the occupants based on the numbers of occupants predicted, said assignment correction value calculation means calculating said assignment correction values based on said distributions of the time periods until the service is available and on said distribution of the occupants.

3. A group-supervising control system for an elevator comprising:

hall call registration means for registering a hall call based on operation of a hall button provided at a hall on each floor;

assignment estimation value calculation means for calculating assignment estimation values for selecting and assigning a cage-to-serve among a plurality of cages;

cage assignment means for assigning a most appropriate cage among said plurality of cages based on said assignment estimation values to a hall call registered in said hall call registration means to transmit to a corresponding cage control system an assignment output for making said cage serve the hall where said hall call is generated;

control means comprising:

cage position prediction means for predicting, based on present cage positions, cage positions after a predetermined time period elapses;

service available time period distribution calculation means for, based on said cage positions predicted by said cage position prediction means, calculating distributions of time periods until service is available, that is, expected arrival times at the respective floors of a cage capable of responding to a hall call earliest;

unoccupied cage detection means for detecting as an unoccupied cage a cage which has responded to hall calls and has neither a cage call nor an assigned hall call;

standby floor set means for setting, based on said distributions of the time periods until the service is available, a standby floor where an unoccupied cage is made to stand by; and standby cage set means for setting a standby cage to stand by on said standby floor among said unoccupied cages, said cage assignment means transmitting to a corresponding cage control system a standby output for making said standby cage stand by on said standby floor.

4. The group-supervising control system for an elevator as claimed in claim 3, wherein said control means further comprises:

generated occupant number prediction means for predicting the number of occupants for the respective floors; and generated occupant distribution calculation means for calculating a distribution of the occupants based on the numbers of occupants to be generated, said standby floor set means setting said standby floor where said unoccupied cage is made to stand by, based on said distributions of the time periods until the service is available and on said distribution of the occupants.

5. A group-supervising control system for an elevator comprising:

hall call registration means for registering a hall call based on operation of a hall button provided at a hall on each floor;

assignment estimation value calculation means for calculating assignment estimation values for selecting and assigning a cage-to-serve among a plurality of cages;

cage assignment means for assigning a most appropriate cage among said plurality of cages based on said assignment estimation values to a hall call registered in said hall call registration means to transmit to a corresponding cage control system an assignment output for making said cage serve the hall where said hall call is generated;

control means comprising:

cage position prediction means for predicting, based on present cage positions, cage positions after a predetermined time period elapses; and service available time period distribution calculation means for, based on the cage positions predicted by said cage position prediction means, calculating distributions of time periods until service is available, that is, expected arrival times at the respective floors of a cage capable of responding to a hall call earliest, said cage assignment means setting a deadhead cage and a deadhead floor based on said distributions of the time periods until the service is available to transmit to a corresponding cage control system a deadhead output for deadheading said deadhead cage to said deadhead floor.

6. The group-supervising control system for an elevator as claimed in claim 5, wherein said control means further comprises:

generated occupant number prediction means for predicting number of occupants for the respective floors; and generated occupant distribution calculation means for calculating a distribution of the occupants based on the numbers of occupants, said cage assignment means setting said deadhead cage and said deadhead floor based on said distributions of the time periods until the service is available and on said distribution of the occupants.

7. A group-supervising control system for an elevator comprising:

hall call registration means for registering a hall call based on operation of a hall button provided at a hall on each floor;

assignment estimation value calculation means for calculating assignment estimation values for selecting and assigning a cage-to-serve among a plurality of cages;

cage assignment means for assigning a most appropriate cage among said plurality of cages based on said assignment estimation values to a hall call registered in said hall call registration means to transmit to a corresponding cage control system an assignment output for making said cage serve the hall where said hall call is generated;

control means comprising:

generated occupant number prediction means for predicting number of occupants to be generated for the respective floors;

generated occupant distribution calculation means for calculating a distribution of the occupants to be generated based on said predicted numbers of occupants;

cage stay time calculation means for calculating cage stay times of the respective cages with regard to the respective floors; and assignment correction value calculation means for calculating assignment correction values for correcting said assignment estimation values based on said distribution of the occupants and on said cage stay times of the respective cages with regard to the respective floors, said cage assignment means correcting said assignment estimation values based on said assignment correction values to select the most appropriate cage and to transmit an assignment output.

8. A group-supervising control system for an elevator comprising:

hall call registration means for registering a hall call based on operation of a hall button provided at a hall on each floor;

assignment estimation value calculation means for calculating assignment estimation values for selecting and assigning a cage-to-serve among a plurality of cages;

cage assignment means for assigning a most appropriate cage among said plurality of cages based on said assignment estimation values to a hall call registered in said hall call registration means to transmit to a corresponding cage control system an assignment output for making said cage serve the hall where said hall call is generated;

control means comprising:

unoccupied cage detection means for detecting as an unoccupied cage a cage which has responded to hall calls and has neither a cage call nor an assigned hall call;

generated occupant number prediction means for predicting number of occupants for the respective floors;

generated occupant distribution calculation means for calculating a distribution of the occupants based on said predicted numbers of occupants;

cage stay time calculation means for calculating cage stay times of the respective cages with regard to the respective floors;

standby floor set means for setting a standby floor where an unoccupied cage is made to stand by based on said distribution of the occupants and on said cage stay times of the respective cages with regard to the respective floors; and standby cage set means for setting a standby cage to stand by on said standby floor among said unoccupied cages, said cage assignment means transmitting to a corresponding cage control system a standby output for making said standby cage stand by on said standby floor.

9. A group-supervising control system for an elevator comprising:

hall call registration means for registering a hall call based on operation of a hall button provided at a hall on each floor;

assignment estimation value calculation means for calculating assignment estimation values for selecting and assigning a cage-to-serve among a plurality of cages;

cage assignment means for assigning a most appropriate cage among said plurality of cages based on said assignment estimation values to a hall call registered in said hall call registration means to transmit to a corresponding cage control system an assignment output for making said cage serve the hall where said hall call is generated;

control means comprising:

generated occupant number prediction means for predicting number of occupants for the respective floors;

generated occupant distribution calculation means for calculating a distribution of the occupants based on said predicted numbers of occupants; and cage stay time calculation means for calculating cage stay times of the respective cages with regard to the respective floors, said cage assignment means setting a deadhead cage and a deadhead floor based on said distribution of the occupants and on said cage stay times of the respective cages with regard to the respective floors to transmit to a corresponding cage control system a deadhead output for deadheading said deadhead cage to said deadhead floor.

* * * * *